US007784219B2

(12) United States Patent
Yoshikawa et al.

(10) Patent No.: US 7,784,219 B2
(45) Date of Patent: Aug. 31, 2010

(54) DOOR OPENING AND CLOSING MECHANISM

(75) Inventors: Takashi Yoshikawa, Izumi (JP); Wataru Nakahama, Nara (JP); Toru Hasegawa, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 711 days.

(21) Appl. No.: 11/666,155

(22) PCT Filed: Sep. 7, 2005

(86) PCT No.: PCT/JP2005/016388

§ 371 (c)(1),
(2), (4) Date: Apr. 24, 2007

(87) PCT Pub. No.: WO2006/048975

PCT Pub. Date: May 11, 2006

(65) Prior Publication Data

US 2009/0139260 A1 Jun. 4, 2009

(30) Foreign Application Priority Data

Nov. 1, 2004 (JP) ..... 2004-317587
Nov. 2, 2004 (JP) ..... 2004-318697
Nov. 2, 2004 (JP) ..... 2004-318756

(51) Int. Cl.
*E05F 1/00* (2006.01)

(52) U.S. Cl. ..... 49/379; 312/296; 292/336.3

(58) Field of Classification Search ..... 49/316, 49/379, 364, 276, 278, 277, 192, 193; 312/296; 292/336.3, DIG. 71
See application file for complete search history.

(56) References Cited

U.S. PATENT DOCUMENTS 4,503,583 A * 3/1985 Frohbieter ..... 16/232
4,947,583 A * 8/1990 Inui et al. ..... 49/193
5,829,197 A * 11/1998 Oh ..... 49/193
5,908,228 A * 6/1999 Lee ..... 312/405

(Continued)

FOREIGN PATENT DOCUMENTS

CN 1294286 A 5/2001

(Continued)

*Primary Examiner*—Jerry Redman
(74) *Attorney, Agent, or Firm*—Birch, Stewart, Kolasch & Birch, LLP

(57) ABSTRACT

A door opening and closing mechanism in which a door to be attached to a body having an opening is separated from, and made in contact with the periphery of the opening so that the opening is opened and closed, is provided with: a handle that is shaft-supported on the door and allowed to pivot with an operation portion being held; and a lever member that has a supporting portion that is attached to the door so as to freely pivot thereon, a connecting portion that is connected to the handle so as to freely pivot thereon on the same side as the operation portion with respect to the rotation axis of the handle, and a contact portion that is placed on the side opposite to the connecting portion with respect to the supporting portion, and arranged face to face with the periphery of the opening, and in this structure when the operation portion is pulled, the contact portion is allowed to press the body so that the door is separated from the periphery of the opening with a predetermined distance.

21 Claims, 23 Drawing Sheets

U.S. PATENT DOCUMENTS

| | | | | |
|---|---|---|---|---|
| 5,915,805 | A | 6/1999 | Lee et al. | |
| 6,655,765 | B2 * | 12/2003 | Kawamura et al. | 312/405 |
| 6,802,155 | B1 | 10/2004 | Kawabata et al. | |
| 6,883,841 | B2 * | 4/2005 | Kawabata et al. | 292/336.3 |
| 7,506,474 | B2 * | 3/2009 | Yoshikawa et al. | 49/257 |
| 7,562,914 | B2 * | 7/2009 | Bassi | 292/173 |
| 2004/0093799 | A1 * | 5/2004 | Yoshikawa et al. | 49/192 |
| 2005/0108945 | A1 * | 5/2005 | Wiemer et al. | 49/278 |
| 2006/0022563 | A1 * | 2/2006 | Huruoka | 312/296 |

FOREIGN PATENT DOCUMENTS

| | | | |
|---|---|---|---|
| DE | 3832860 | A1 * | 4/1989 |
| JP | 10-132448 | A | 5/1998 |
| JP | 2000-18803 | A | 1/2000 |
| JP | 2002-90044 | A | 3/2002 |
| WO | WO-2006/048975 | A1 | 5/2006 |

* cited by examiner

FIG.12
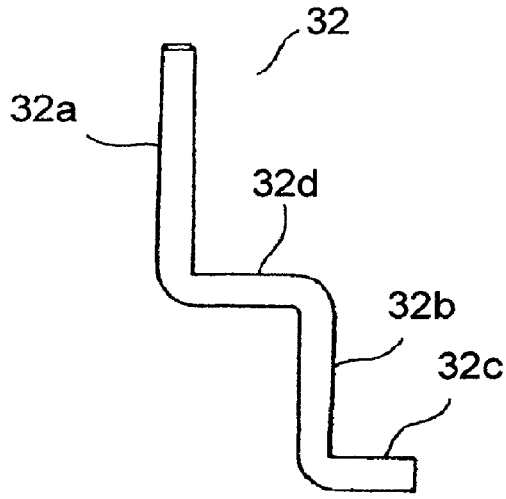
FIG.13A
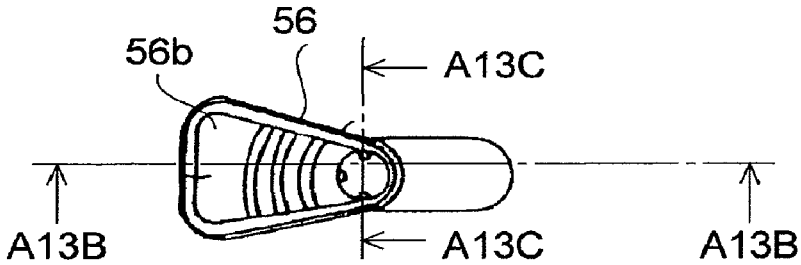
FIG.13B
FIG.13C
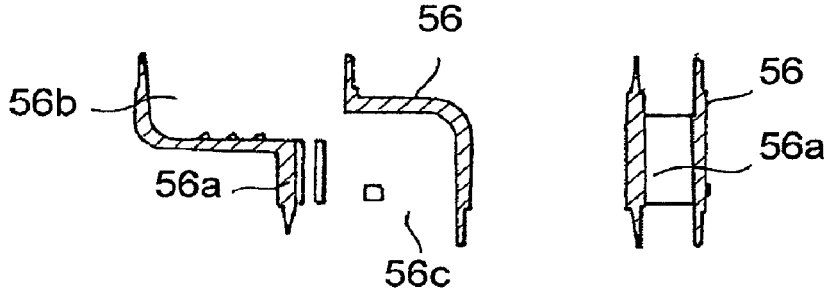

DOOR OPENING AND CLOSING MECHANISM

TECHNICAL FIELD

The present invention relates to a door opening and closing mechanism used for opening and closing a door of a refrigerator or the like.

BACKGROUND ART

A conventional door opening and closing mechanism in which a door to be attached to a body having an opening is separated from, and made in contact with the periphery of the opening so that the opening is opened and closed has been disclosed in Patent Document 1. This door opening and closing mechanism has a structure in which: the door is attached to the body so as to freely pivot and a handle is shaft-supported on the door. The handle has an operation portion to be held and operated by the user, and the end portion of the handle on the side opposite to the operation portion with respect to the rotation axis is placed face to face with the periphery of the opening. When the operation portion is pulled to allow the handle to pivot, the end portion is pressed against the body through the principle of a lever. Thus, the door is separated from the periphery of the opening with a predetermined distance even by a small operation force, and by further pulling the operation portion, the door is allowed to pivot and opened.

Patent Document 1: JP-A-2000-18803 (pages 2-3, FIG. 3)

DISCLOSURE OF THE INVENTION

Problems to be Solved by the Invention

In the conventional door opening and closing mechanism, however, in order to reduce the operation force on the handle, it is necessary to lengthen the operation portion. In addition, the end portion to press the body is placed on the side opposite to the operation portion. For this reason, a large-size handle is required and the radius of the pivotal movement becomes larger to cause degradation in the operability. Moreover, in the case when a space in which the handle is placed is limited, the operation portion and the rotation axis need to be placed closely, failing to make the operation force sufficiently lighter.

The object of the present invention is to provide a door opening and closing mechanism that can achieve a small size with a lighter operation force.

Means for Solving the Problem

In order to achieve the above-mentioned object, the present invention relates to a door opening and closing mechanism in which a door to be attached to a body having an opening is separated from, and made in contact with the periphery of the opening so that the opening is opened and closed, is provided with: a handle that is shaft-supported on the door and allowed to pivot with an operation portion being held; and a lever member that is provided with a supporting portion that is attached to the door so as to freely pivot thereon, a connecting portion that is connected to the handle so as to freely pivot thereon on the same side as the operation portion with respect to the rotation axis of the handle and a contact portion that is placed on the side opposite to the connecting portion with respect to the supporting portion, and arranged face to face with the periphery of the opening, and in this arrangement, when the operation portion is pulled, the contact portion is allowed to press the body so that the door is separated from the periphery of the opening with a predetermined distance.

With this arrangement, when the operation portion is held and pulled, the lever member, which is connected to the handle through the connecting portion, is allowed to pivot centered on the supporting portion. The contact portion is allowed to pivot by the pivotal movement of the lever member so that the periphery of the opening is pressed. The operation force of the handle is amplified by the principle of a lever, and transmitted to the connecting portion, and the resulting force is further amplified by the lever member, and transmitted to the contact portion. Here, the operation portion and the connecting portion are placed on the same side with respect to the rotation axis of the handle so that the handle and the lever member are placed in an overlapped manner in a plan view as well as in a front view. Additionally, since the handle and the lever member have mutually different centers of pivotal movement, at least one of the supporting portion and the connecting portion is fitted to the door or the handle so as to be freely pivot therein.

In the present invention, with respect to the door opening and closing mechanism having the above-mentioned arrangement, the lever member is provided with a crank shaft that forms the connecting portion and the supporting portion in cooperation with first and second shaft portions that are placed in parallel with each other, and the contact portion is perpendicularly provided in the second shaft portion so that the operation portion and the contact portion are placed within different planes that are perpendicular to the rotation axis of the handle. With this arrangement, the lever member is connected to the handle at the first shaft portion, and is also supported on the door at the second shaft portion. The lever member allows the operation force of the handle to be transmitted to the first shaft portion so that the contact portion pivots centered on the second shaft portion serving as its rotation axis.

The present invention features that in the door opening and closing mechanism having the above-mentioned structure, the first shaft portion is fitted to an elongated hole formed in the handle so as to freely pivot therein. With this arrangement, following the pivotal movement of the handle, the first shaft portion is relatively shifted within the elongated hole and engaged so that the crank shaft is allowed to pivot.

Moreover, the present invention features that in the door opening and closing mechanism having the above-mentioned structure, the rotation axis of the handle and the contact portion are placed on the side opposite to the above-mentioned connecting portion. With this arrangement, the lever member is placed within the width of the handle, and the distance between the rotation axis of the handle and the connecting portion can be shortened.

The present invention features that in the door opening and closing mechanism having the above-mentioned structure, the door is held in the body so as to freely pivot therein, and that the pivotal movement of the door allows the opening to be closed and opened. With this arrangement, when the handle is pulled, the door is allowed to pivot and opened.

The present invention features that in the door opening and closing mechanism having the above-mentioned structure, the handle and the lever member are symmetrically placed on each of the two sides of the door, and that two cam mechanisms that allow the door and the body to be engaged with, and separated from each other are symmetrically placed on each of the two sides of the door, and in this arrangement, in a closed state of the door, the cam mechanisms on the two sides are maintained at first symmetrical engaged positions, and upon opening one of the doors, the door is slide-shifted outward from the one door, while the other cam mechanism is shifted to a second engaging position so that the door is locked in a manner so as to freely pivot, with the operation portion being placed in the center side of the doors from the rotation axis of the handle.

With this arrangement, for example, in the case when handles are placed on the right and left sides of the doors, upon pulling the handle on the left side, the door is allowed to pivot forward from left side and to slide leftward, and the engagement of the cam mechanism on the left side is released so that the cam mechanism on the right side is shifted from the first engaging position to the second engaging position. The cam mechanism on the right side holds a box supporting shaft at the second engaging position so that the door is allowed to pivot.

Moreover, the present invention features that in the door opening and closing mechanism having the above-mentioned structure, the door is held in a manner so as to slide backward and forward with respect to the body so that the opening is opened and closed when the door is allowed to slide backward and forward. With this arrangement, when the handle is pulled, the door is allowed to slide forward and opened.

Furthermore, the present invention relates to a door opening and closing mechanism in which a door to be attached to a body having an opening is separated from, and made in contact with the periphery of the opening so that the opening is opened and closed, is provided with: a force-boosting mechanism that has a handle that is shaft-supported on the door and a contact portion that is arranged face to face with the periphery of the opening so that, when the handle is rotated, an operation force is transmitted to the contact portion, wherein, upon rotating the handle, the contact portion is pressed against the body so that the door is separated from the periphery of the opening with a predetermined gap. With this arrangement, when the handle is held and pulled, the operation force is amplified by the force-boosting mechanism, and then transmitted to the contact portion so that the contact portion is allowed to press the periphery of the opening to open the door.

Moreover, the present invention relates to a door opening and closing mechanism in which a door to be attached to a body having an opening is separated from, and made in contact with the periphery of the opening so that the opening is opened and closed, is provided with: a handle that is shaft-supported on the door and allowed to pivot with the operation portion being held; a crank shaft made of metal, which has a first shaft portion that is placed on the same side as the operation portion with respect to the rotation axis of the handle, and fitted to the handle so as to freely pivot thereon and a second shaft portion that is formed in parallel with the first shaft portion, and supported on the door; a contact portion that is placed on the second shaft portion on the side opposite to the first shaft portion in a manner so as to extend perpendicularly from the second shaft portion, and aligned face to face with the periphery of the opening; and a first stopper with which the first shaft portion that pivots centered on the second shaft portion is made in contact to regulate the pivotal movement of the handle, and in this arrangement, when the operation portion is pulled, the contact portion is allowed to press the body so that the door is separated from the periphery of the opening with a predetermined distance.

With this arrangement, the crank shaft that is coupled to the handle through the first shaft portion is allowed to pivot centered on the second shaft portion when the operation portion is held and pulled. The contact portion is allowed to pivot to press the periphery of the opening by the pivotal movement of the crank shaft. The operation force of the handle is amplified by the principle of a lever, and transmitted to the first shaft portion, and the resulting force is further amplified by the crank shaft, and transmitted to the contact portion. Here, the operation portion and the first shaft portion are placed on the same side with respect to the rotation axis of the handle so that the handle and the crank shaft are placed in an overlapped manner in a plan view as well as in a front view. The first shaft portion, placed on the same side as the operation portion with respect to the rotation axis of the handle, is made in contact with the first stopper to regulate the pivotal movement of the handle so that the door is allowed to pivot, with the handle being maintained at the same position with respect to the door.

Moreover, the present invention features that in the door opening and closing mechanism having the above-mentioned structure, a second stopper with which the end portion of the handle placed on the side opposite to the operation portion with respect to the rotation axis of the handle is made in contact to regulate the pivotal movement of the handle is provided on the door. With this arrangement, the first shaft portion is made in contact with the first stopper, with the end portion of the handle being made in contact with the second stopper, so that the pivotal movement of the handle is regulated. Here, a time difference may be prepared between the contact of the first shaft portion with the first stopper and the contact of the handle with the second stopper.

The present invention features that in the door opening and closing mechanism having the above-mentioned structure, the door is provided with a recessed portion in which the handle is accommodated, and that the first stopper is formed as a hole portion that is formed into an arc shape concentric with the second shaft portion on the wall face of the recessed portion, with the first shaft portion being inserted through the hole portion. With this arrangement, in a closed state of the door, the handle is accommodated in the recessed portion, and when the operation portion is pulled, the handle is allowed to pivot and protrudes from the recessed portion. The first shaft portion, coupled to the handle through the arc-shaped hole portion formed on the wall face of the recessed portion, is made in contact with the periphery of the opening so that the pivotal movement of the handle is regulated.

The present invention features that in the door opening and closing mechanism having the above-mentioned structure, a buffer member, which buffers an impact exerted upon contact with the first shaft portion, is attached to the first stopper. With this arrangement, the buffer member is placed along the periphery of the hole portion formed on the wall face of the recessed portion so that the first shaft portion is made in contact with the buffer member through its pivotal movement to compress the buffer member.

Moreover, the present invention features that in the door opening and closing mechanism having the above-mentioned structure, the buffer member is attached onto the inner side of the door from the surface of the recessed portion. In this arrangement, the buffer member is attached onto the door inner side of the hole portion.

The present invention features that in the door opening and closing mechanism having the above-mentioned structure, the first stopper is formed as the inner face of a shaft cover, placed on the door, through which the crank shaft is inserted. With this arrangement, a foaming material to be injected into the inside of the door is shield with the shaft cover, and the crank shaft is inserted through the inside of the shaft cover. The first shaft portion, which is placed inside the shaft cover and coupled to the handle, is made in contact with the inner face of the shaft cover so that the pivotal movement of the handle is regulated. The first stopper is made of a protrusion or the like formed on the wall face on the inner face side of the shaft cover or the inner face thereof.

Moreover, the present invention features that in the door opening and closing mechanism having the above-mentioned structure, a protruding portion, which is made in contact with the first shaft portion, is formed on the inner wall of the shaft cover. With this arrangement, the first shaft portion is made in contact with the first stopper prepared as the protruding portion on the inner side of the shaft cover so that the pivotal movement of the handle is regulated.

The present invention, which relates to a door opening and closing mechanism in which a door to be attached to a body having an opening is separated from, and made in contact with the periphery of the opening so that the opening is opened and closed, is provided with: a handle that is shaft-supported on the door and allowed to pivot with the operation portion being held; a crank shaft which has a first shaft portion that is placed on the same side as the operation portion with respect to the rotation axis of the handle, and fitted to the handle so as to freely pivot thereon, a second shaft portion that is formed in parallel with the first shaft portion through a connecting portion formed by bending the end portion of the first shaft portion, and supported on the door, and a bent portion that is formed by bending the tip of the second shaft portion in a perpendicular direction toward the side opposite to the first shaft portion; a contact portion that is attached to the bent portion to be integrally formed with the second shaft portion, and placed face to face with the periphery of the opening; a shaft cover that is placed on the door with the crank shaft being inserted therein, and has first and second spaces in which the first and second shaft portions are respectively placed with a width that allows at least one of the connecting portion and the bent portion to be inserted therein, with a fitting section to which the second shaft portion is fitted being formed at the end of the second space by opening one of the ends in the width direction thereof; and a supporting member having a holding portion that is fitted to the second space to be held therein and a shaft supporting portion that supports the opened side of the second shaft portion fitted to the fitting section, and in this arrangement, when the operation portion is pulled, the contact portion presses the body so that the door is separated from the periphery of the opening with a predetermined distance.

In this arrangement, when the handle is held and pulled, the crank shaft coupled to the handle through the first shaft portion, is allowed to pivot centered on the second shaft portion. The contact portion that is integral with the bent portion is allowed to pivot by the pivotal movement of the lever so that the periphery of the opening is pressed. The operation force of the handle is amplified by the principle of a lever, and transmitted to the first shaft portion, and the resulting force is further amplified by the crank shaft, and transmitted to the contact portion. Here, the operation portion and the first shaft portion are placed on the same side with respect to the rotation axis of the handle so that the handle and the crank shaft are placed in an overlapped manner in a plan view as well as in a front view.

The crank shaft is inserted through the shaft cover attached to the door, and the first and second spaces are formed into a crank shape so as to communicate with each other, for example, when viewed from the front face; thus, the first and second shaft portions are placed in the first and second spaces. In the case when the bent portion is shorter than the continuous portion, each of the first space and the second space is formed with a width wider than the length of the bent portion, and the crank shaft is inserted therein from the open end of the first space. Moreover, in the case when the continuous portion is shorter than the bent portion, each of the first space and the second space is formed with a width wider than the length of the continuous portion, and the crank shaft is inserted therein from the open end of the second space. One end of the second space is formed into, for example, a cylinder face shape so that, while one of semi-circular faces of the second shaft portion is opened, the other semi-circular face thereof is fitted to the fitting section and thus supported. The supporting member is maintained in the second space, and the opened side of the second shaft portion is supported by the end face of the shaft supporting portion that is placed on the end of the supporting member.

Moreover, the present invention features that in the door opening and closing mechanism having the above-mentioned structure, the shaft supporting portion has a cylinder face that is formed along the peripheral face of the second shaft portion. With this arrangement, the second shaft portion is supported by the cylinder face.

The present invention features that in the door opening and closing mechanism having the above-mentioned structure, the shaft supporting portion is longer than the holding portion in the axis direction of the second shaft portion.

Moreover, the present invention features that in the door opening and closing mechanism having the above-mentioned structure, a plurality of ribs with which the supporting member is made in contact so as to be position-determined in the axis direction of the supporting member are placed side by side on the inner wall of the second space in the width direction so as to protrude therefrom. With this arrangement, the supporting member to be inserted from the opened side of the second space is made in contact with the ribs, and position-determined in the axis direction.

Moreover, the present invention features that in the door opening and closing mechanism having the above-mentioned structure, a step difference with which the supporting member is made in contact so as to be position-determined in the axis direction of the supporting member is formed on the inner wall of the second space. With this arrangement, the supporting member to be inserted from the opened side of the second space is made in contact with the step difference, and position-determined in the axis direction.

The present invention features that in the door opening and closing mechanism having the above-mentioned structure, a distance between the open end of the second space and the bent portion is set to a value greater than the thickness of the holding portion. With this arrangement, the supporting member can be inserted into the second space through the clearance between the second opening and the bent portion.

Advantages of the Invention

In accordance with the present invention, since the lever member, which is provided with a supporting portion that is attached to the door so as to freely pivot thereon, a connecting portion that is connected to the handle so as to freely pivot thereon on the same side as the operation portion with respect to the rotation axis of the handle and a contact portion that is placed on the side opposite to the connecting portion with respect to the supporting portion, and arranged face to face with the periphery of the opening, is provided; thus, by placing the handle and the lever member in an overlapped manner, it becomes possible to miniaturize the door opening and closing mechanism and the operation force used for pulling the operation portion can be amplified by the lever member so that the door is opened with a lighter operation force.

In accordance with the present invention, since the lever member is provided with a crank shaft having the first and second shaft portions, it becomes possible to easily achieve a small-size door opening and closing mechanism that only requires a light operation force. Moreover, the handle can be placed at a desired position apart from the contact portion that is placed face to face with the periphery of the opening.

In accordance with the present invention, since the first shaft portion is fitted to an elongated hole formed in the handle so as to freely pivot therein, the supporting portion is rotatably secured to the door so that the pressing position by the contact portion is set to a fixed position.

In accordance with the present invention, since the rotation axis of the handle and the contact portion are placed on the side opposite to the above-mentioned connecting portion, the door opening and closing mechanism is further miniaturized and the door can be opened with a lighter operation force.

In accordance with the present invention, cam mechanisms are placed on the two sides of the doors, and upon opening one of the doors, the door is slide-shifted outward from the one of the door, with the operation portion being placed in the center side of the doors from the rotation axis of the handle; therefore, upon pulling the operation portion, the door can be easily slide-shifted so that the operability of the door opening and closing mechanism can be improved.

In accordance with the present invention, since a force-boosting mechanism that transmits the operation force of the handle to the contact portion is provided, the door opening and closing mechanism is further miniaturized and the door can be opened with a lighter operation force.

In accordance with the present invention, a crank shaft, which has a first shaft portion that is placed on the same side as the operation portion with respect to the rotation axis of the handle, and fitted to the handle so as to freely pivot thereon and a second shaft portion that is formed in parallel with the first shaft portion, and supported on the door, is provided; thus, by placing the handle and the lever member in an overlapped manner, it becomes possible to miniaturize the door opening and closing mechanism and the operation force used for pulling the operation portion can be amplified by the crank shaft so that the door is opened with a lighter operation force.

Moreover, since the first shaft portion of the crank shaft made of metal is made in contact with the first stopper to regulate the pivotal movement of the handle, it is not necessary to reinforce the first shaft portion so that the pivotal movement of the handle is regulated at low costs. Furthermore, since the operation portion and the first shaft portion are placed on the same side with respect to the rotation axis of the handle, the operation portion and the first shaft portion are closely positioned. For this reason, when the first shaft portion and the first stopper are made in contact with each other, the force to be applied to the stopper becomes smaller, and the torque to be applied to the handle also becomes smaller, since the torque is applied through the first shaft portion serving as the fulcrum. Therefore, it becomes possible to prevent the first stopper and the handle from damages.

In accordance with the present invention, since a second stopper with which the end portion of the handle placed on the side opposite to the operation portion with respect to the rotation axis of the handle is made in contact to regulate the pivotal movement of the handle is provided on the door, the pivotal movement of the handle is regulated by the first and second stoppers; therefore, loads are dispersed onto the first and second stoppers so that it becomes possible to prevent the first and second stoppers and the handle from damages.

In accordance with the present invention, since the first stopper is formed in a wall face of a recessed portion to accommodate the handle as a hole portion that is formed into an arc shape concentric with the second shaft portion and through which the first shaft portion is inserted; therefore, it is possible to easily achieve the first stopper that is made in contact with the first shaft portion without increasing the number of parts. Moreover, since the handle and the first stopper are provided closely in the axis direction, even when the crank shaft is tilted on the first stopper serving as a fulcrum, it is possible to prevent the handle from a great load applied thereto.

Moreover, in accordance with the present invention, since a buffer member, which buffers an impact exerted upon contact with the first shaft portion, is attached to the first stopper, it is possible to alleviate an impact sound due to the collision of the first shaft portion made of metal.

In accordance with the present invention, since the buffer member is attached onto the inner side of the door from the surface of the recessed portion, the interference between the handle and the buffer member is prevented so that the handle is allowed to pivot smoothly.

In accordance with the present invention, since the first stopper is formed as the inner face of the shaft cover, placed on the door, through which the crank shaft is inserted, it is possible to easily achieve the first stopper to be made in contact with the first shaft portion without increasing the number of parts.

Moreover, in accordance with the present invention, since a protruding portion, which is made in contact with the first shaft portion, is formed on the inner wall of the shaft cover, the strength of the first stopper made of the protruding portion can be improved.

In accordance with the present invention, since a crank shaft, which has a first shaft portion that is placed on the same side as the operation portion with respect to the rotation axis of the handle, and fitted to the handle so as to freely pivot thereon, a second shaft portion that is formed in parallel with the first shaft portion, and supported on the door and a bent portion that is formed by bending the tip of the second shaft portion in a perpendicular direction toward the side opposite to the first shaft portion, is provided; therefore, by placing the handle and the crank shaft in an overlapped manner, it becomes possible to miniaturize the door opening and closing mechanism and the operation force used for pulling the operation portion can be amplified by the handle and the crank shaft so that the door is opened with a lighter operation force.

Moreover, since the second shaft portion is supported by a fitting section, formed in the shaft cover, through which the crank shaft is inserted and a supporting member that is fitted to the shaft cover, it becomes possible to prevent positional deviations in the second shaft portion, and consequently to allow the handle to pivot more smoothly.

In accordance with the present invention, since the shaft supporting portion of the supporting member has a cylinder face that is formed along the peripheral face of the second shaft portion, it is possible to prevent positional deviations of the second shaft portion and consequently to support the second shaft portion more positively.

In accordance with the present invention, since the shaft supporting portion of the supporting member is longer than the holding portion in the axis direction of the second shaft portion, it becomes possible to support the second shaft portion more positively.

Moreover, in accordance with the present invention, since a plurality of ribs with which the supporting member is made in contact so as to be position-determined in the axis direction are placed side by side on the inner wall of the second space in the width direction so as to protrude therefrom, the supporting member is easily position-determined, and it is possible to prevent the supporting member from tilting so that the second shaft portion is supported more positively.

Moreover, in accordance with the present invention, since a step difference with which the supporting member is made in contact so as to be position-determined in the axis direct ion is formed on the inner wall of the second space, the supporting member can be easily position-determined and it becomes possible to prevent the supporting member from tilting so that the second shaft portion is supported more positively.

In accordance with the present invention, since a distance between the open end of the second space and the bent portion is set to a value greater than the thickness of the holding portion, the supporting member can be more easily inserted into the second space.

BRIEF DESCRIPTION OF DRAWINGS

[FIG. 12A] front view that shows a crank shaft of the refrigerator of the first embodiment of the present invention.

[FIG. 13A] A top view that shows a shaft cover of the refrigerator of the first embodiment of the present invention.

[FIG. 13B] A sectional front view, taken on section A13B-A13B in FIG. 13A, that shows the shaft cover of the refrigerator of the first embodiment of the present invention.

[FIG. 13C] A sectional side view, taken on section A13C-A13C in FIG. 13A, that shows the shaft cover of the refrigerator of the first embodiment of the present invention.

LIST OF REFERENCE SYMBOLS

Figure 1:
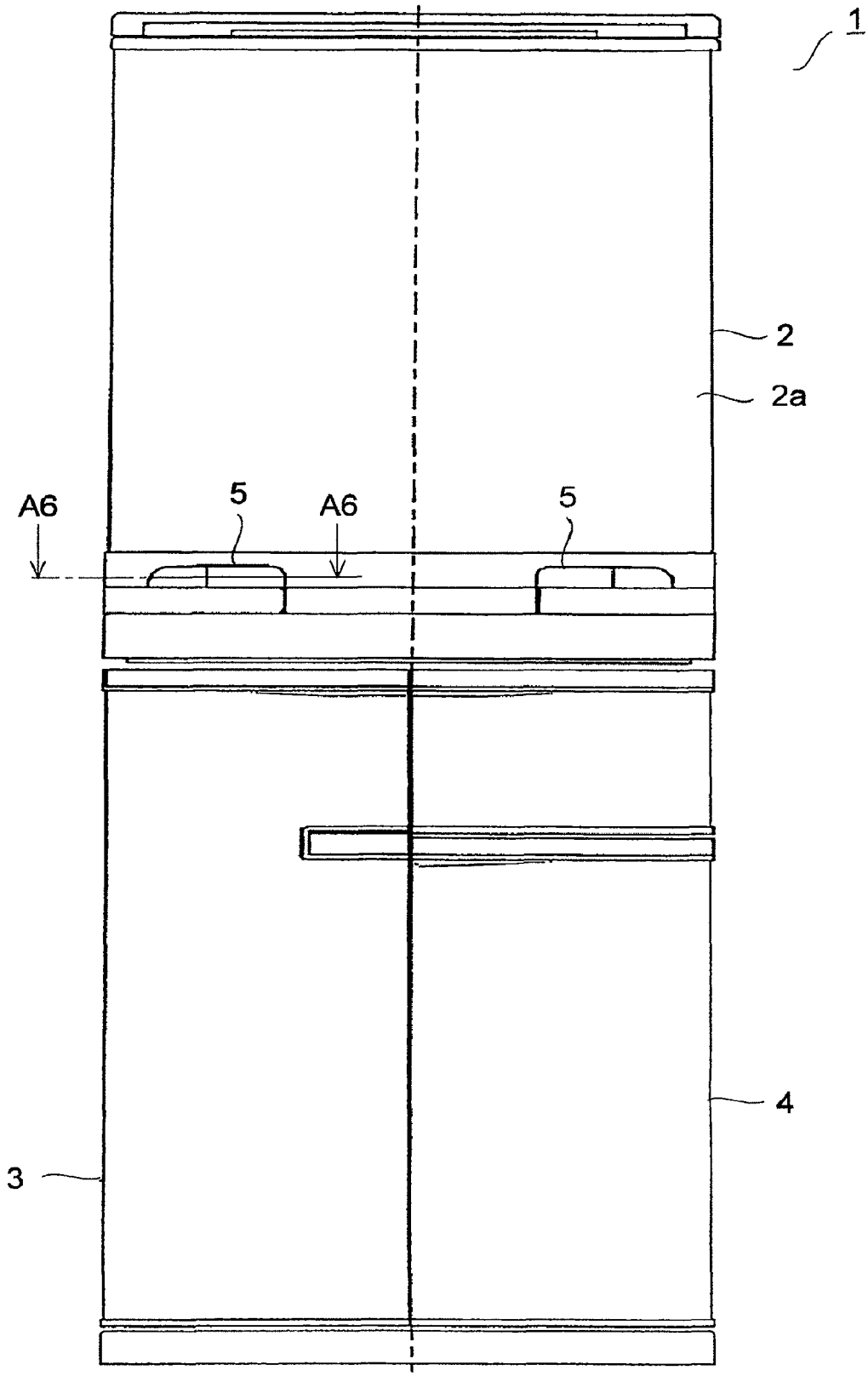
[FIG. 1] A front view that shows a refrigerator in accordance with a first embodiment of the present invention.

1 Refrigerator
2 Refrigerating chamber
2*a* Door
3 Vegetable chamber
4 Freezing chamber
5 Handle

5*a* Operation portion
6 Body
10 Hinge angle
11 Hinge pin
12 Lock outer cam
13 Rib
20 Slide cam member
22 Slide outer cam
23 Boss
24 First groove cam
25 Second groove cam
30 Lever member
31 Cam lever (contact portion)
32 Crank shaft
32*a* First shaft portion (connecting portion)
32*b* Second shaft portion (supporting portion)
51 Shaft
52 Handle body
52*c* Rib
53 Handle reinforcing angle
53*a* Elongated hole
54 Handle decoration panel
56 Shaft cover
56*a* Fitting section
56*b* First space
56*c* Second space
56*d*, 56*f* Rib
56*e* Step difference
56*h* Protruding portion (first stopper)
57 Supporting member
57*a* Holding portion
57*b* Shaft supporting portion
58 Door cap cover
58*a* Hole (first stopper)
58*b* Engaging stopper (second stopper)
59 Buffer member

BEST MODE FOR CARRYING OUT THE INVENTION

Referring to Figures, the following description will discuss an embodiment of the present invention. FIG. 1 is a front view that shows a refrigerator provided with a door opening and closing mechanism in accordance with one embodiment. A refrigerator 1 has a refrigerating chamber 2 on an upper stage and a vegetable chamber 3 and a freezing chamber 4 that are placed side by side laterally on a lower stage. The refrigerating chamber 2 is covered, on the front side of the body 6 (see FIG. 4), with a door 2*a* openable at both the left and right sides thereof, and is designed to be opened from either of the right and left sides through operation of handles 5 that are placed symmetrically on the right and left sides, as will be described later in detail.

Figure 2:
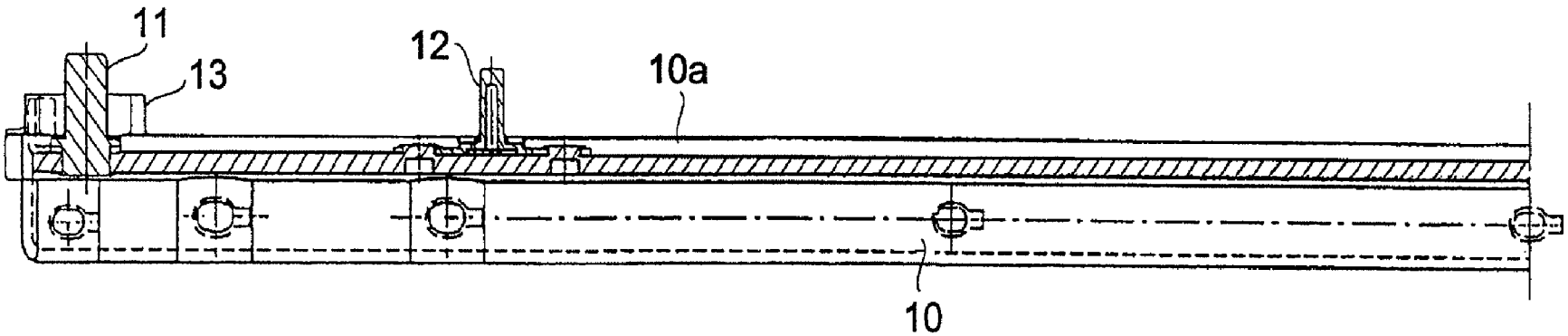
[FIG. 2] A sectional front view, taken on section A2-A2 in FIG. 3, that shows a hinge angle of the refrigerator of the first embodiment of the present invention.
Figure 3:
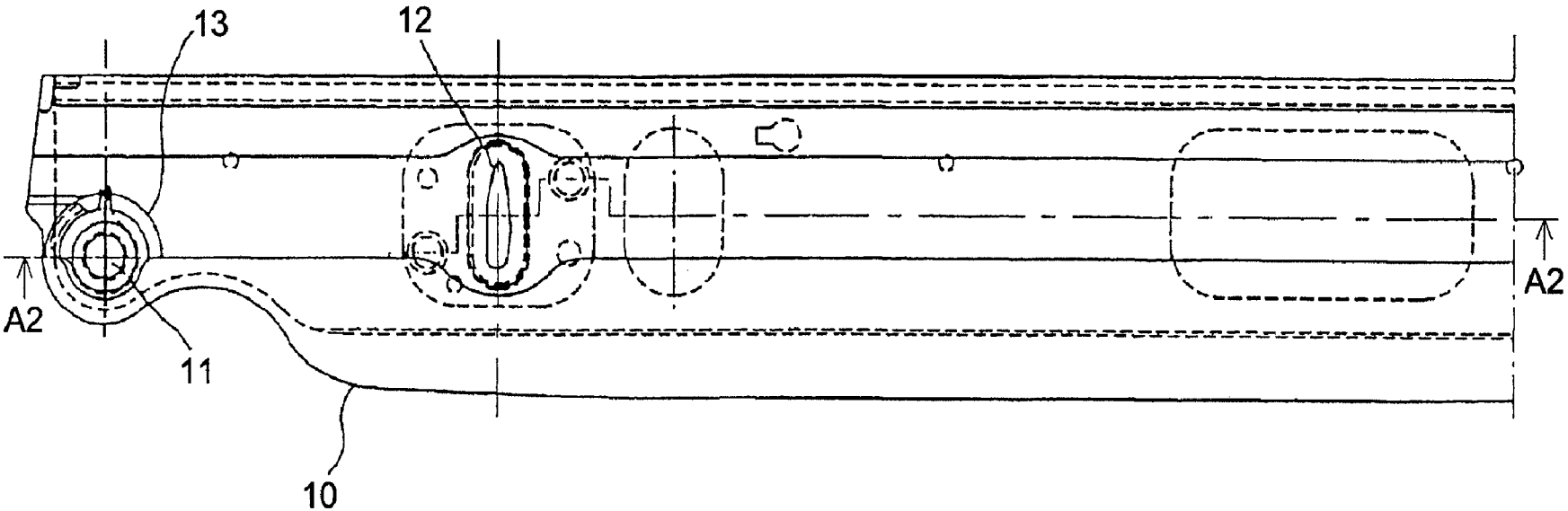
[FIG. 3] A plan view that shows the hinge angle of the refrigerator of the first embodiment of the present invention.

FIGS. 2 and 3 are a front view and an upper face view that show a left half of a hinge angle 10 placed at a lower portion on the body 6 (see FIG. 4) of the refrigerating chamber 2. The hinge angle 10 is formed into a right-to-left symmetrical shape by using a metal plate such as a zinc-plated steel plate, and secured to the body 6 with screws. A hinge pin 11 and a lock outer cam 12, made of stainless steel or the like, are right-to-left symmetrically secured to the hinge angle 10 through caulking.

Moreover, a hinge cover 10*a* is placed on the upper face of the hinge angle 10 through an insert molding process. The hinge pin 11 serves as a supporting shaft of the door 2*a*, and an arc-shaped rib 13, which is concentric with the hinge pin 11 is integrally formed with the hinge cover 10*a*. The lock outer cam 12 is placed apart from the hinge pin 11 with a predetermined distance, and slides on a slide outer cam 22 (see FIG. 4) to guide the door 2*a*.

Figure 4:
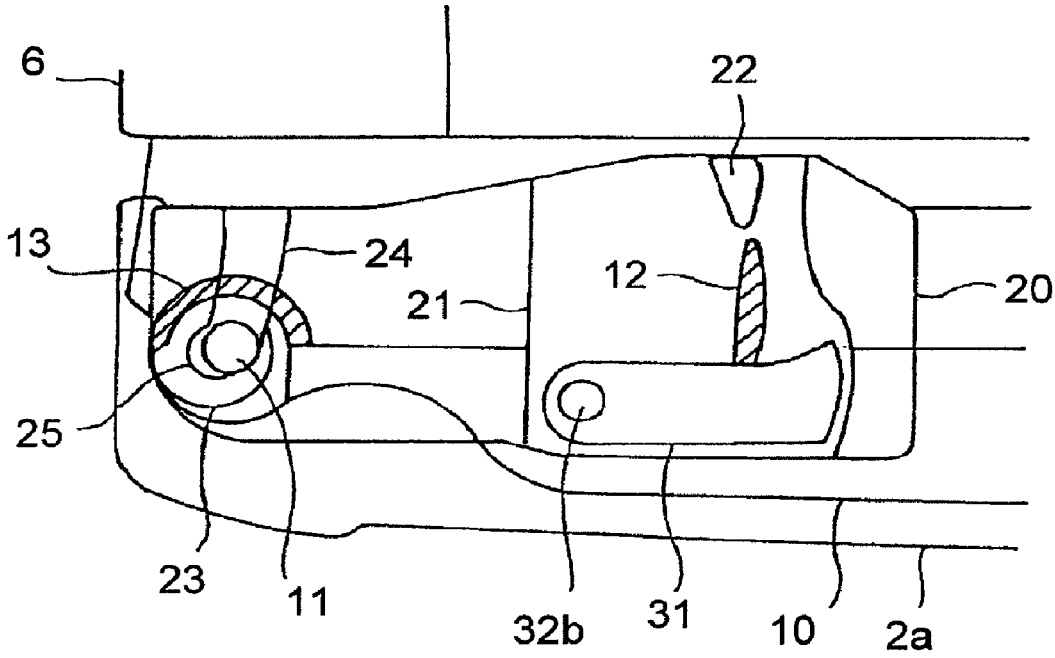
[FIG. 4] A plan view that shows a slide cam member of the refrigerator of the first embodiment of the present invention.

FIG. 4 is a plan view that shows an engagement relationship between a slide cam member 20 and the hinge angle 10 that are placed at the lower end on the left side of the door 2*a*. Two slide cam members 20 are symmetrically provided on the right and left ends of the door 2*a*. First and second grooved cams 24 and 25, which are continuously formed into a virtually L-letter shape as recesses, and guide the hinge pin 11 relatively in a sliding manner, are formed on the end portions of the slide cam member 20.

A boss 23, which slides on the rib 13, is formed in a protruding manner on the periphery of the second grooved cam. A groove portion 21 is formed as a recessed portion on the right side of the first and second grooved cams 24 and 25. A slide outer cam 22, which faces the lock outer cam 12, is formed in a protruding manner in the groove portion 21. With this arrangement, the slide cam member 20 and the hinge angle 10 are mutually engaged with each other to form a cam mechanism that guides the door 2*a*. Here, in FIG. 4, the respective structures of the slide cam member 20, which are formed on the lower face, are indicated by solid lines for convenience of explanation.

Moreover, the slide cam members 20 are also provided in right-to-left symmetry on the upper face of the door 2*a*, and the hinge pin 11, the lock outer cam 12 and the rib 13, which are engaged with each slide cam member 20, are provided on the upper side of the body 6.

A cam lever 31 is placed inside the groove portion 21 of the slide cam member 20 placed on the lower face of the door 2*a*. The cam lever 31 is arranged face to face with the lock outer cam 12, and allowed to pivot centered on the second shaft portion 32*b* of a crank shaft 32 (see FIG. 5) supported on the door 2*a*.

Figure 5:
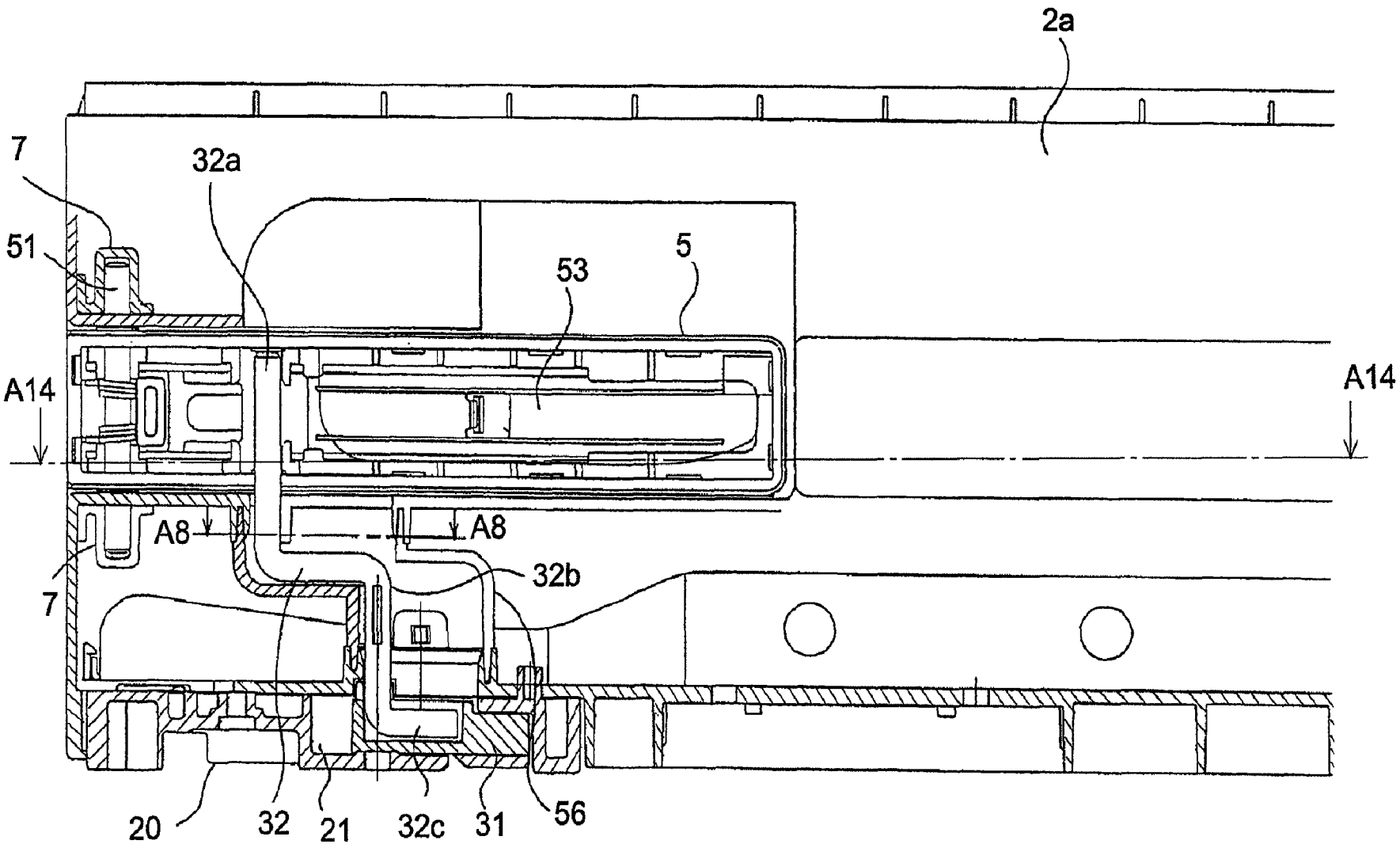
[FIG. 5] A sectional front view, taken on section A5-A5 in FIG. 6, that shows the inside of, and parts above and below, a handle of a door of the refrigerator of the first embodiment of the present invention.
Figure 6:
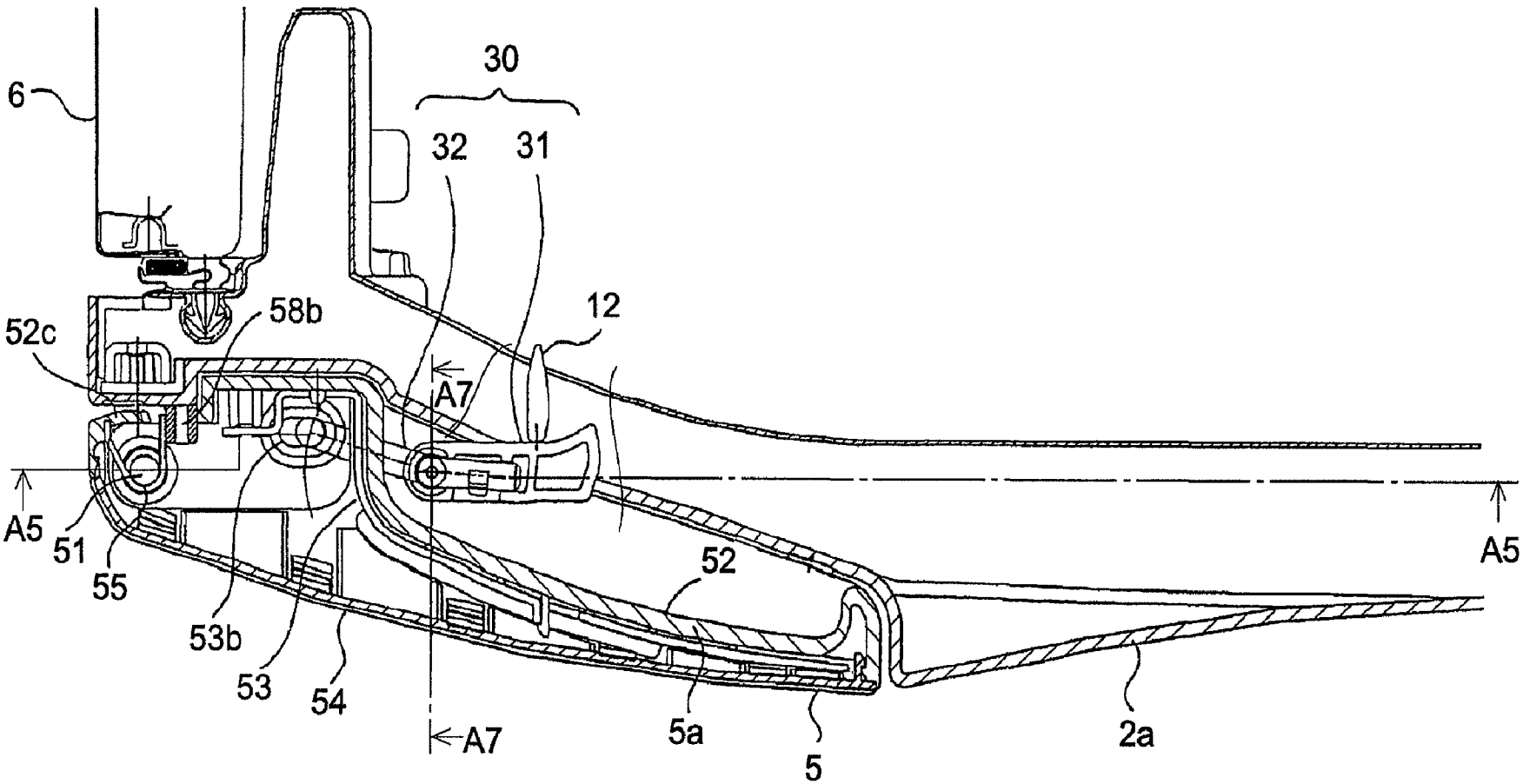
[FIG. 6] A sectional plan view, taken on section A6-A6 in FIG. 1, that shows a handle portion of a door of the refrigerator of the first embodiment of the present invention.
Figure 7:
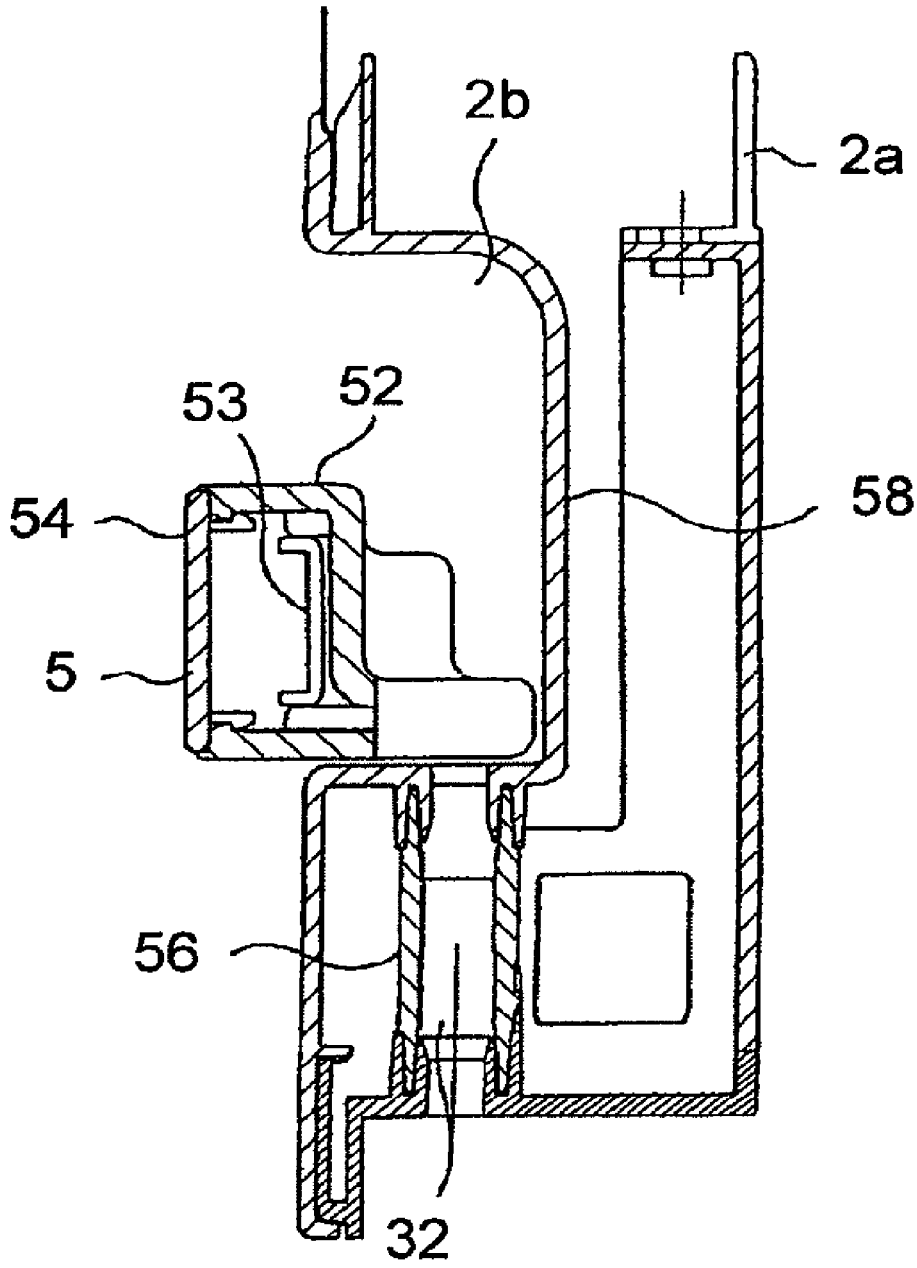
[FIG. 7] A sectional side view, taken on section A7-A7 in FIG. 1, that shows the handle portion of a door of the refrigerator of the first embodiment of the present invention.
Figure 8:
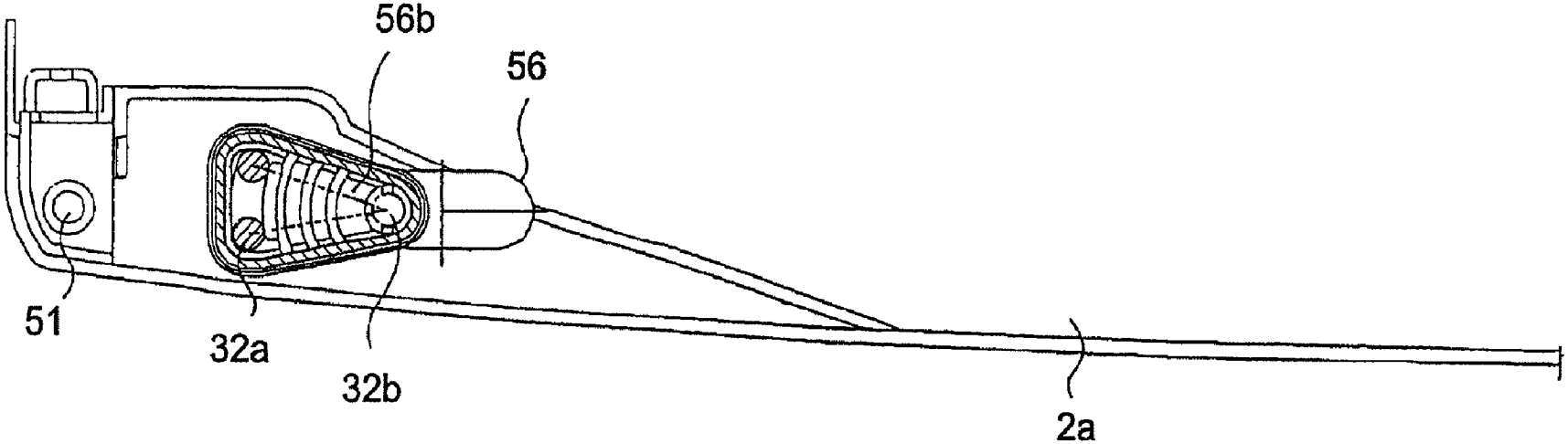
[FIG. 8 A] sectional view taken on section A8-A8 in FIG. 5.

FIGS. 5, 6 and 7 are a sectional front view, a sectional upper face view and a sectional side view that show the lower left portion of the door 2*a*. FIG. 8 is a sectional view taken along line A-A of FIG. 5. The handle 5 is supported by a shaft 51 that is fitted to a shaft receiver 7 provided in the door 2*a*, and one portion thereof is accommodated in the recessed portion 2*b* formed in the door 2*a*. Thus, the handle 5 is allowed to pivot on the shaft 51 serving as a rotation shaft when the operation portion 5*a* is held and pulled forward.

The recessed portion 2*b*, formed in the door 2*a*, has wall faces constituted by door cap covers 58 made of a resin molded product. In the door cap cover 58 forming the lower face inner wall of the recessed portion 2*b*, an arc shaped hole 58*a* (first stopper: see FIG. 14) is formed. In the vicinity of the shaft 51 of the door cap cover 58, an engaging stopper 58*b* (second stopper) is placed in a manner so as to stick out. A twisted spring 55 is inserted into the shaft 51. The twisted spring 55 is sandwiched between the inner wall of the handle 5 and the engaging stopper 58*b* so that the pivoting handle 5 is returned to the original position.

Figure 9A:
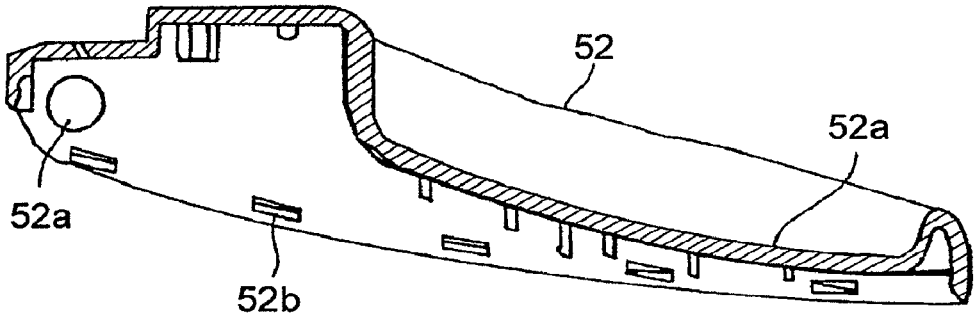
[FIG. 9A ] A sectional top view, taken on section A9A-A9A in FIG. 9B, that shows a handle body of the refrigerator of the first embodiment of the present invention.
Figure 9B:
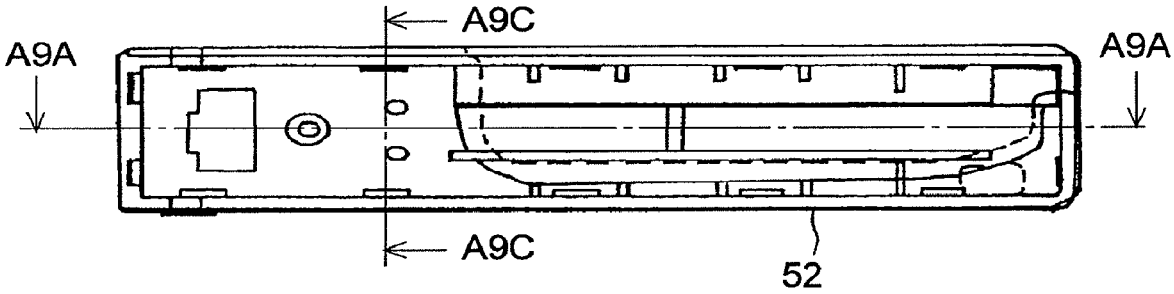
[FIG. 9B] A front view that shows the handle body of the refrigerator of the first embodiment of the present invention.
Figure 9C:
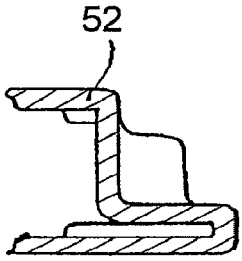
[FIG. 9C] A sectional side view, taken on section A9C-A9C in FIG. 9B, that shows the handle body of the refrigerator of the first embodiment of the present invention.

The handle 5 is constituted by a handle body 52, a handle reinforcing angle 53 and a handle decoration panel 54. FIGS. 9A to 9C are a plan view, a front view and a side view that show the handle body 52. The handle body 52, which is made of a resin molded product, is provided with a through hole 52*a* into which the shaft 51 is inserted, at its one end. The portion thereof from the through hole 52*a* toward the center side of the door 2*a* forms an open end on which the operation portion 5*a* to be held by the user is formed. At the end portion on the side opposite to the operation portion 5*a* with respect to the through hole 52*a*, an L-shaped rib 52*c*, which is made in contact with the engaging stopper 58*b* by the pivotal movement of the handle 5, is provided.

Figure 10A:
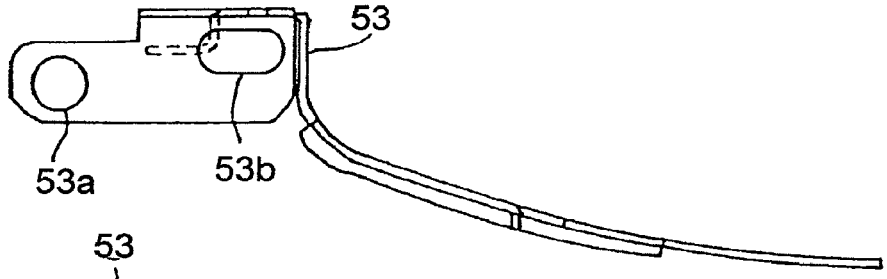
[FIG. 10A] is a top view that shows a handle reinforcing angle of the refrigerator of the first embodiment of the present invention.
Figure 10B:
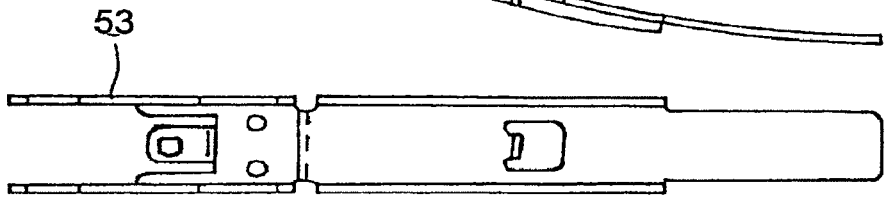
[FIG. 10B] is a front view that shows the handle reinforcing angle of the refrigerator of the first embodiment of the present invention.

FIGS. 10A and 10B are a plan view and a front view that show a handle reinforcing angle 53. The handle reinforcing angle 53, which is made of a metal plate, is attached to the front face of the handle body 52 so as to reinforce the handle 5. A through hole 53*a* into which the shaft 51 is inserted is formed at one end of the handle reinforcing angle 53. On the same side as the operation portion 5*a* with respect to the through hole 53*a,* an elongated hole 53*b* into which a first shaft portion 32*a* (see FIG. 12) of the crankshaft 32 is inserted is formed.

Figure 11A:
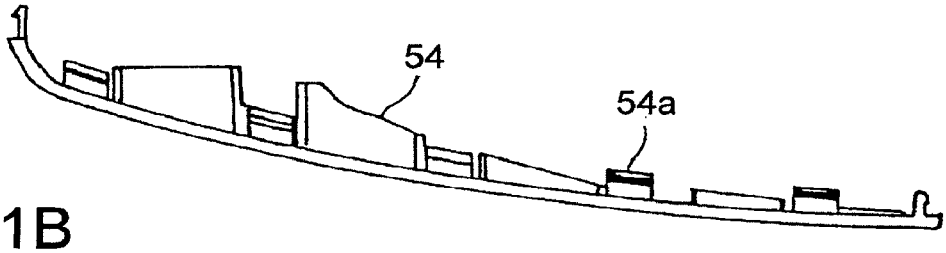
[FIG. 11A] A top view that shows a handle decoration panel of the refrigerator of the first embodiment of the present invention.
Figure 11B:
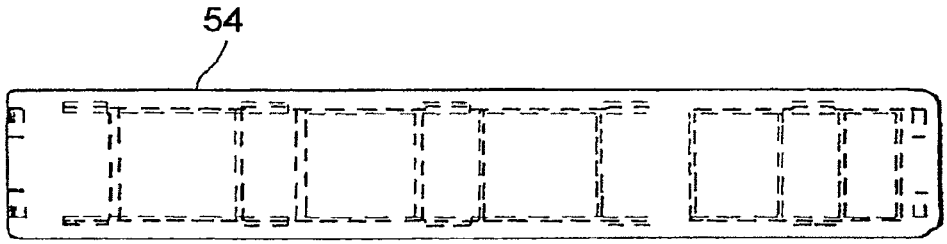
[FIG. 11B] A front view that shows the handle decoration panel of the refrigerator of the first embodiment of the present invention.
Figure 11C:
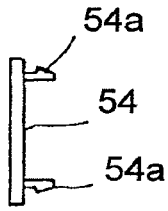
[FIG. 11C] A side view that shows the handle decoration panel of the refrigerator of the first embodiment of the present invention.

FIGS. 11A to 11C are a plan view, a front view and a side view that show the handle decoration plate 54. The handle decoration plate 54, which is made of a resin molded product, is attached to the handle body 52, with an engaging claw 54*a* formed on the rear side in a protruding manner being engaged with an engaging hole 52*b* (see FIG. 9A).

FIG. 12 is a front view that shows the crank shaft 32. The crank shaft 32, which is formed by bending a metal plate, is provided with first and second shaft portions 32*a* and 32*b* that are in parallel with each other. A bent portion 32*c,* which is bent in a direction opposite to the first shaft portion 32*a* is formed on the lower end of the second shaft portion 32*b.* A cam lever 31 (see FIG. 6) is attached to the bent portion 32*c,* and the cam lever 31 is placed perpendicular to the second shaft portion 32*b.* A continuous portion 32*d,* which connects the lower end of the first shaft portion 32*a* to the upper end of the second shaft portion 32*b,* is formed through a bending process.

The first shaft portion 32*a* is inserted through the elongated hole 53*b* of the handle reinforcing angle 53 so as to freely rotate therein so that a connecting portion, which connects the handle 5 to the crank shaft 32, is formed. The crank shaft 32 is used for connecting the handle 5 and the cam lever 31 to each other so that the handle 5 is placed at a desired position apart in an upward or downward direction from the cam lever 31 that is aligned face to face with the periphery of the opening of the body 6; thus, it becomes possible to achieve a convenient structure.

A shaft cover 56 is attached to the door 2*a* below the handle 5. FIGS. 13A to 13C are a plan view, a front view and a side view that show the shaft cover 56. The shaft cover 56, which is a resin molded product, is designed to shield foaming resin to be injected into the door 2*a* and also to allow the crank shaft 32 to be inserted therein.

A first space 56*b* with a virtually arc shape in its plan view, which permits rotation of the first shaft portion 32*b* therein, is formed at an upper portion of the shaft cover 56. A second space 56*c,* which forms a fitting section 56*a* having a U-letter shape in its sectional view, is formed at a lower portion of the shaft cover 56. The second shaft portion 32*b* (supporting portion) of the crank shaft 32 is supported by the fitting section 56*a* so as to freely rotate therein. With this arrangement, the crank shaft 32 and the cam lever 31 constitute a lever member 30 that pivots centered on the second shaft portion 32*b* through a pivotal movement of the handle 5.

Figure 14:
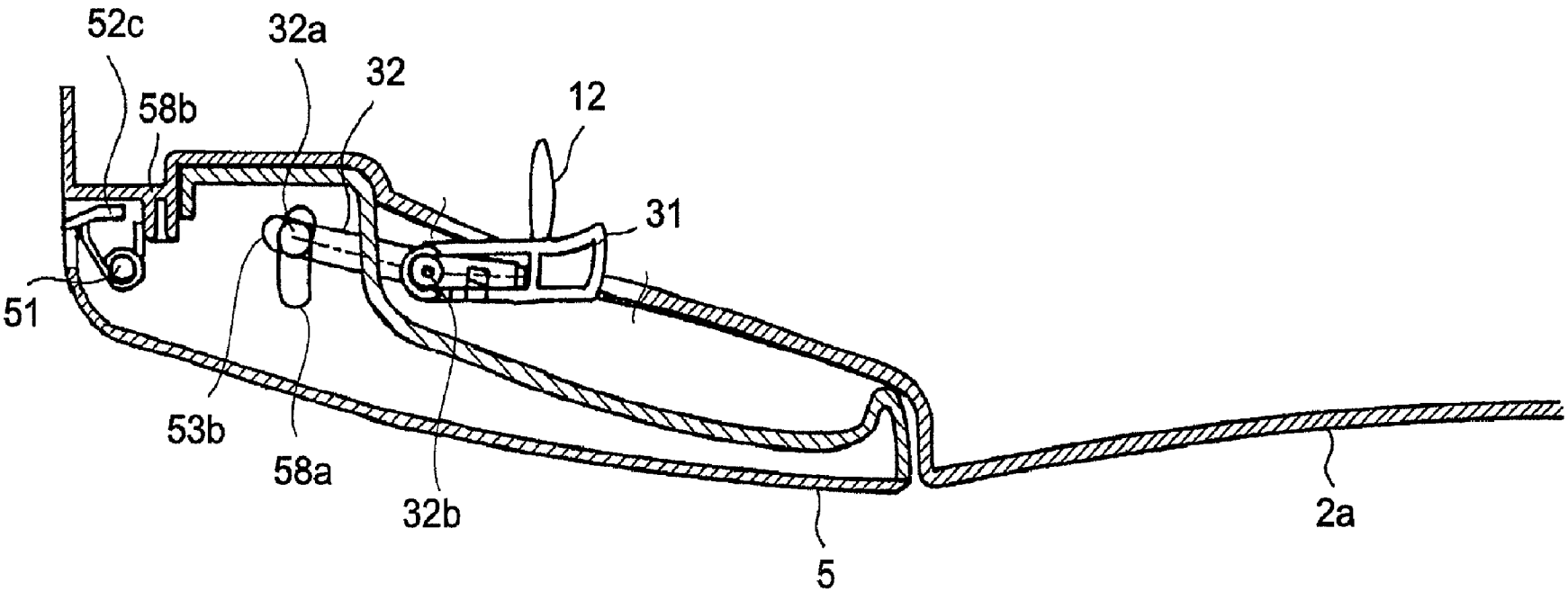
[FIG. 14] A sectional plan view, taken on section A14-A14 in FIG. 5, that shows the handle portion of a door of the refrigerator of the first embodiment of the present invention.

As shown in FIG. 14, a hole 58*a* in the door cap cover 58 is formed into an arc shape that is concentric with the second shaft portion 32*b,* and the first shaft portion 32*a* is inserted therein. In a state in which the handle 5 is accommodated in a recessed portion 5*b*, the first shaft portion 32*a* is placed at the end portion on the rear side of the hole 58*a.* When the crank shaft 32 is rotated, the first shaft portion 32*a* is allowed to slide inside the hole 58*a.*

Figure 15:
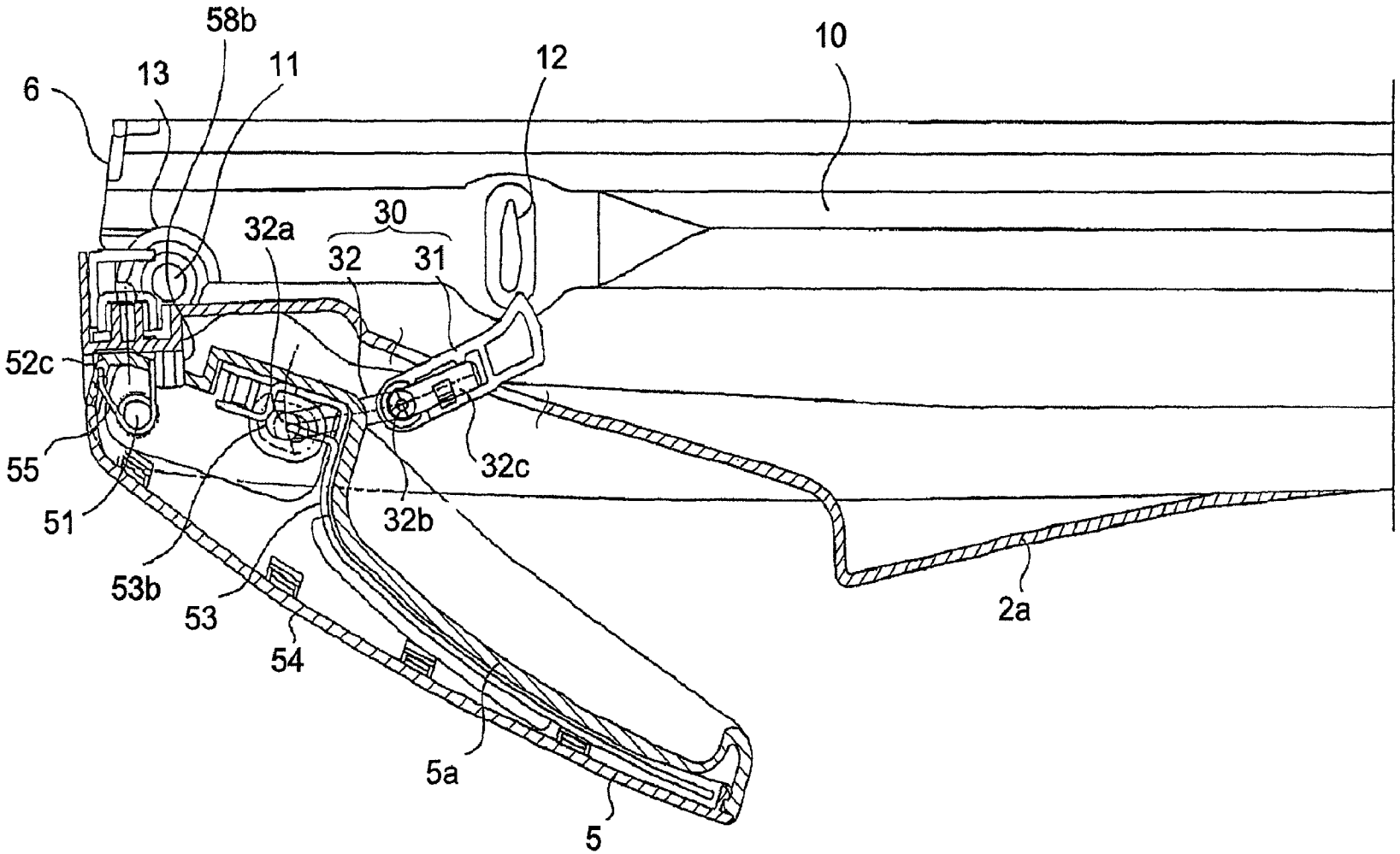
[FIG. 15] A sectional plan view, taken on the same section as FIG. 6, that shows the handle portion upon opening the door of the refrigerator of the first embodiment of the present invention.

In the door opening and closing mechanism having the above-mentioned structure, when the operation portion 5*a* of the handle 5 is pulled, the operation force is transmitted to the first shaft portion 32*a* through the elongated hole 53*a* so that the first shaft portion 32*a* is allowed to pivot forward inside the first space 56*b.* By the pivotal movement of the first shaft portion 32*a,* the crank shaft 32 is rotated centered on the second shaft portion 32*b* to allow the cam lever 31 to pivot rearward and press the lock outer cam 12. Thus, as shown in FIG. 15, the door 2*a* is separated from the periphery of the opening with a predetermined distance.

At this time, in comparison with the distance between the operation portion 5*a* and the shaft 51, the distance between the first shaft portion 32*a* (connecting portion) and the shaft 51 is made shorter so that the operation force of the operation portion 5*a* is amplified. Moreover, in comparison with the distance between the first shaft portion 32*a* (connecting portion) and the second shaft portion 32*b* (supporting portion), the distance between the second shaft portion 32*b* and the portion of the cam lever 31 to be made in contact with the lock outer cam 12 is made shorter. Thus, the operation force is further amplified. Therefore, the handle 5 and the lever member 30 are allowed to constitute a force-boosting mechanism so that the lock outer cam 12 can be pressed by a lighter operation force.

Moreover, since the operation portion 5*a* and the first shaft portion 32*a* are placed on the same side with respect to the shaft 51 so that the handle 5 and the lever member 30 are placed in an overlapped manner on the plan view. With this arrangement, the lever member 30 is placed within the width of the handle 5 in the lateral direction. Therefore, even when the size of the handle 5 is limited, the distance between the operation portion 5*a* and the shaft 51 is made longer so that a door opening and closing mechanism, which has a greater amplifying rate in the operation force with a small size, can be obtained. In the case when there is a space at the lower end of the door 2*a,* the lever member 30 may be placed in a manner so as to protrude from the width of the handle 5.

Furthermore, since the shaft 51 and the cam lever 31 are placed on the side opposite to the first shaft portion 32*a,* the distance between the shaft 51 and the first shaft portion 32*a* can be shortened with the lever 30 being placed within the width of the handle 5 in the lateral direction. Therefore, it becomes possible to amplify the operation force more greatly.

Here, the distance between the second shaft portion 32*b* and the portion of the cam lever 31 to be made in contact with the lock outer cam 12 may be made virtually equal to, or slightly longer than the distance between the first shaft portion 32*a* and the second shaft portion 32*b.* In this arrangement, the amplifying effect by the lever member 30 is not obtained. However, the distance between the operation portion 5*a* and the shaft 51 is made longer so that it is possible to obtain a door opening and closing mechanism that has a great amplifying rate in the operation force with a small size.

Moreover, since the handle 5 and the lever member 30 have mutually different centers of rotation, the first shaft portion 32*a,* which couples these members, is fitted to an elongated hole 53*a* so as to freely move therein. The first shaft portion 32*a* may be secured to the handle 5 so as to freely pivot therein, and the second shaft portion 32*b* may be fitted to the door 2*a* so as to freely move therein. When the second shaft portion 32*b* is secured thereto with the first shaft portion 32*a* being fitted so as to freely move therein, the pressing position of the cam lever 31 is fixedly maintained to provide a stable pressing operation.

Figure 16:
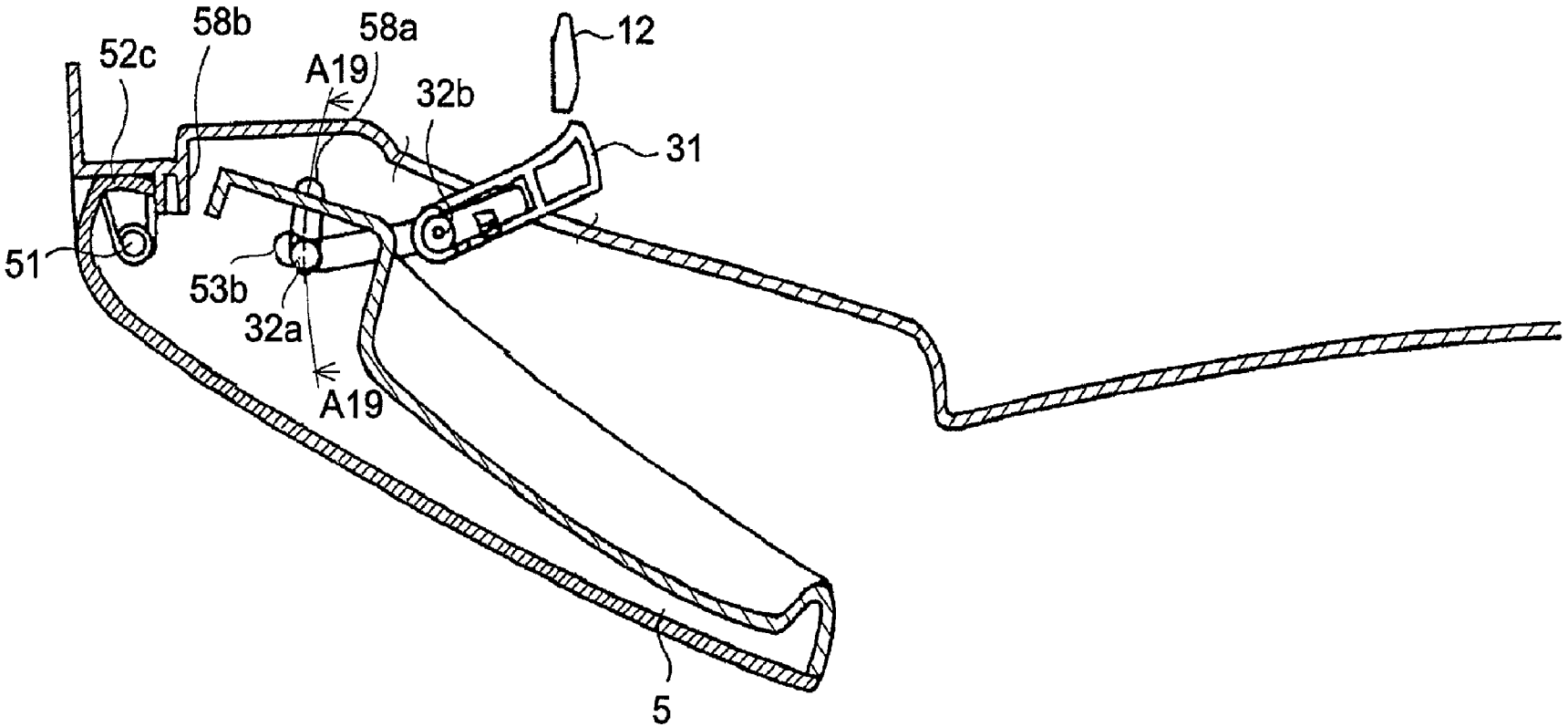
[FIG. 16] A sectional plan view, taken on the same section as FIG. 14, that shows another section of the handle portion upon opening the door of the refrigerator of the first embodiment of the present invention.
Figure 17:
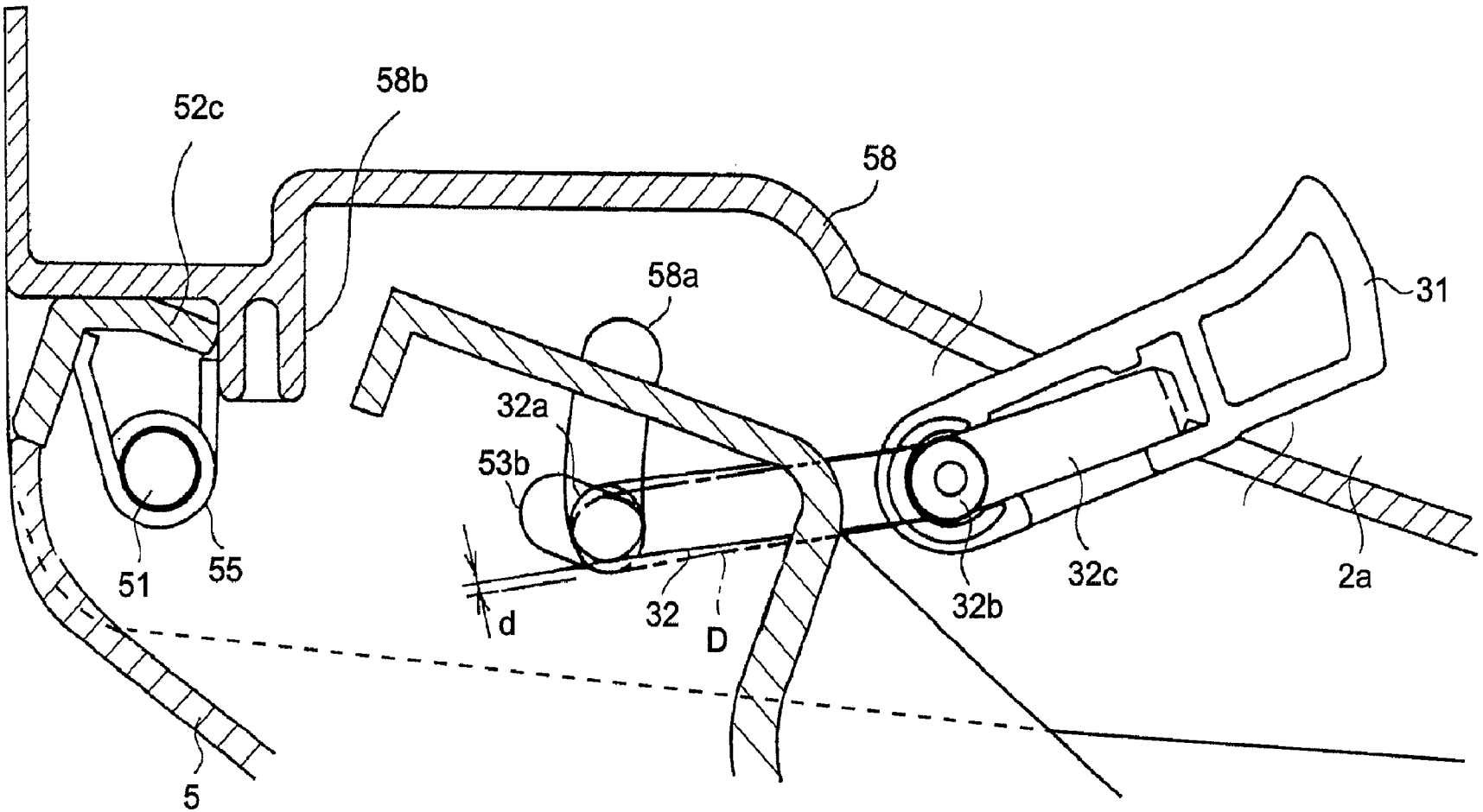
[FIG. 17] A sectional plan view that shows an essential portion of FIG. 16.

FIG. 16 is a plan view that shows a layout of the handle 5 in its section different from that of FIG. 15. The handle 5 is limited in its range of pivotal movement with its rib 52*c* made in contact with the engaging stopper 58*b* of the door cap cover 58. FIG. 17 shows an essential portion of FIG. 16 in detail. The pivotal movement of the handle 5 allows the first shaft portion 32*a* of the crank shaft 32 to move toward the front face side of the hole 58*a*. When the rib 52*c* and the engaging stopper 58*b* are made in contact with each other, a clearance "d" is formed between the first shaft portion 32*a* and the end portion of the hole portion 58*a* on the front side.

When the operation portion 5*a* is further pulled, the handle 5 is elastically deformed to cause the crank shaft 32 to pivot so that as indicated by an alternate long and short dash line D, the first shaft portion 32*a* is made in contact with the end portion of the hole 58*b* to limit the range of the pivotal movement of the handle 5. The contact between the rib 52*c* and the engaging stopper 58*b* and the contact between the first shaft portion 32*a* and hole 58*b* may take place simultaneously, or with a time difference.

Figure 18:
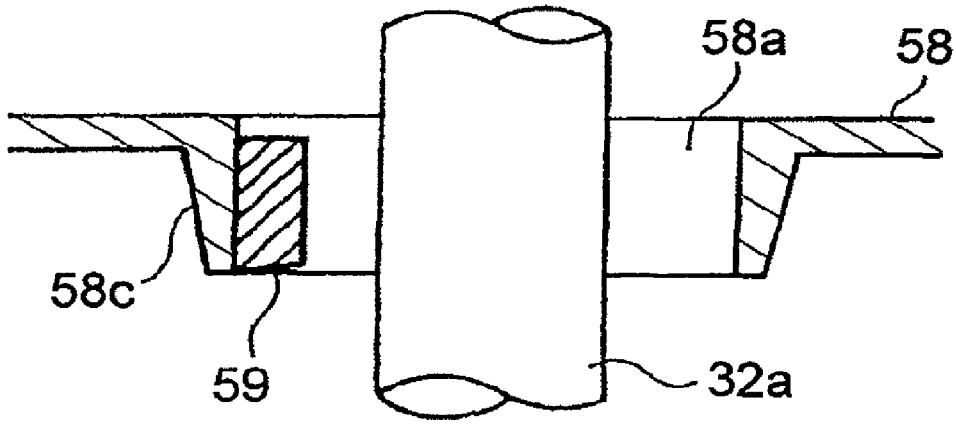
[FIG. 18] A vertical sectional view, taken on section A19-A19 in FIG. 16, that shows a hole portion of a door cap cover of the refrigerator of the first embodiment of the present invention.

FIG. 18 shows a sectional view of the hole 58*a*. The peripheral edge of the hole 58*a* is made of a rib 58*c* that extends downward, and a buffer member 59, made of rubber, sponge or the like, is attached to the rib 58*c* on the front side of the hole 58*a*. By providing the buffer member 59, it is possible to alleviate an impact sound due to the collision of the first shaft portion 32*a* of the crank shaft 32 made of metal. Moreover, since the buffer member 59 is placed inside the door 2*a* apart from the surface of the recessed portion 2*b* without sticking out from the surface of the recessed portion 2*b*, it becomes possible to prevent the handle 5 from interfering with the buffer member 59 and consequently to rotate the handle smoothly.

When the handle 5 is further pulled, the door 2*a* is allowed to pivot and opened, with the first shaft portion 32*a* made in contact with the end portion of the hole 58*b*.

Figure 19:
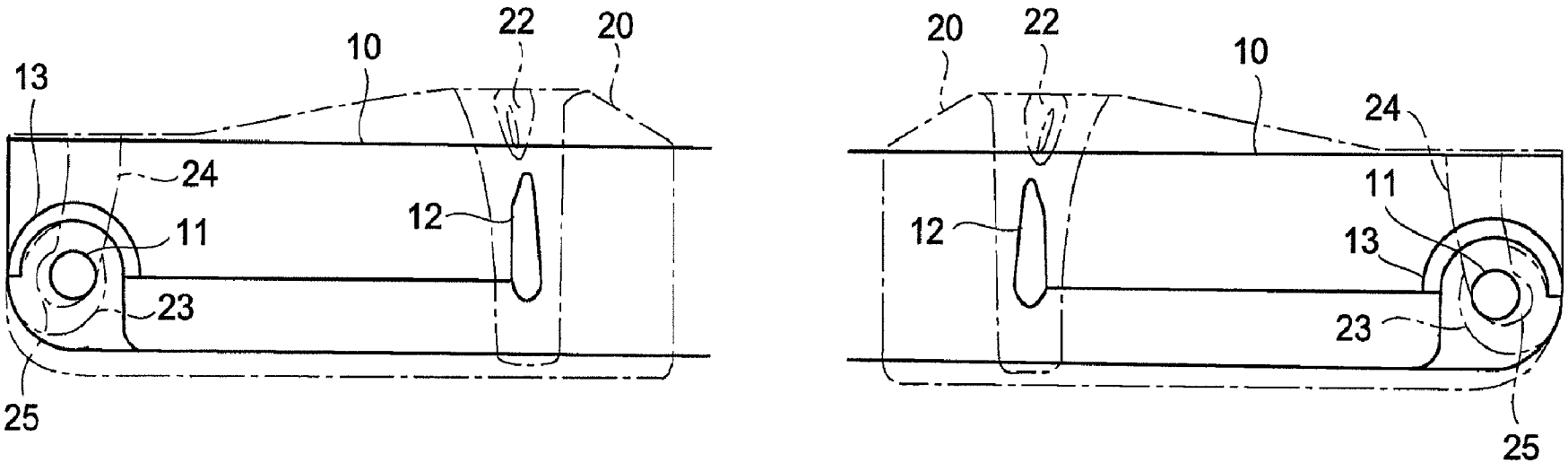
[FIG. 19] A plan view that shows an operation of a cam mechanism upon opening the door of the refrigerator of the first embodiment of the present invention.

FIGS. 19 to 22 are plan views that indicate operations of the cam mechanism upon opening the door 2*a*. In a closed state of the door 2*a*, as shown in FIG. 19, each of the right and left cam mechanisms is set to a first engaged position in which the hinge pin 11 is placed at the end portion of the first grooved cam 24. Since the first grooved cam 24 is made to tilt toward the center of the door 2*a* in an increasing degree toward the rear portion, the door 2*a* is prevented from coming off even when the two sides thereof are pulled.

Figure 20:
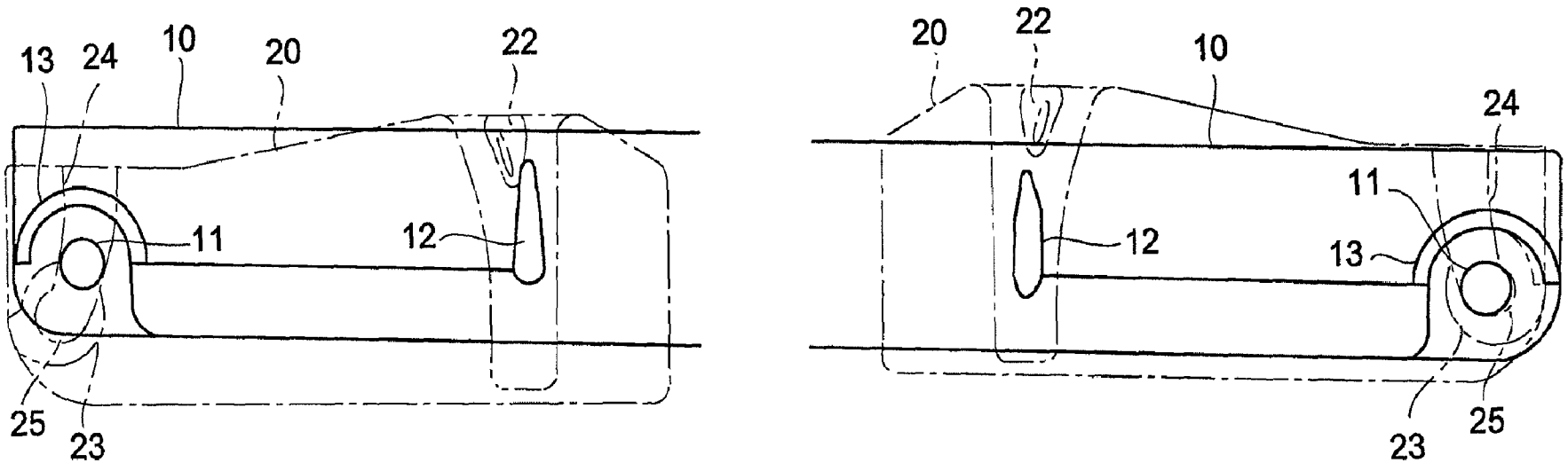
[FIG. 20] A plan view that shows an operation of a cam mechanism upon opening the door of the refrigerator of the first embodiment of the present invention.

When the operation portion 5*a* of the handle 5 on the left side of the door 2*a* is pulled, the lock outer cam 12 on the left side is pressed by the cam lever 31, as shown in FIG. 15, so that the door 2*a* is separated from the body 6. FIG. 20 shows the state at this time. In the cam mechanism on the left side, the hinge pin 11 is relatively guided by the first grooved cam 24 so that the lock outer cam 12 and the slide outer cam 22 are allowed to slide on each other. In the cam mechanism on the right side, the hinge pin 11 is relatively guided by the second outer cam 25. With this arrangement, the door 2*a* is slide-shifted leftward while pivoting.

Figure 21:
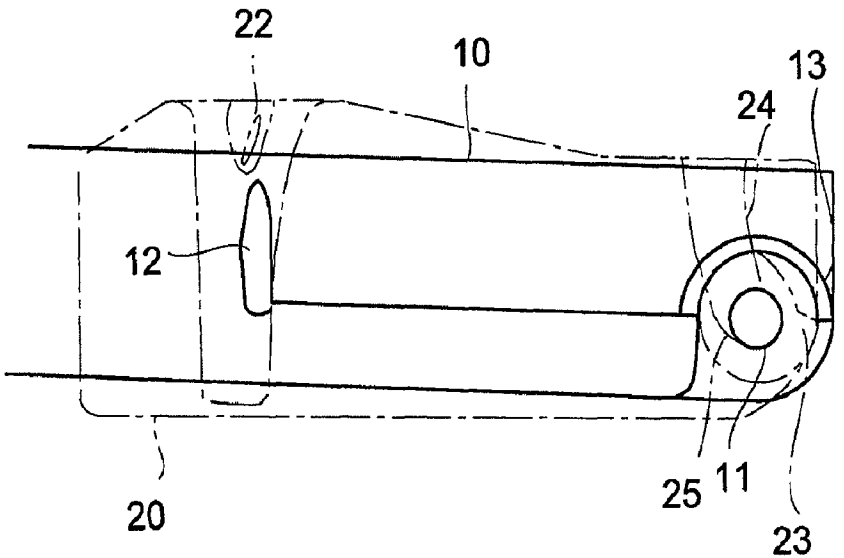
[FIG. 21] A plan view that shows an operation of a cam mechanism upon opening the door of the refrigerator of the first embodiment of the present invention.
Figure 21:
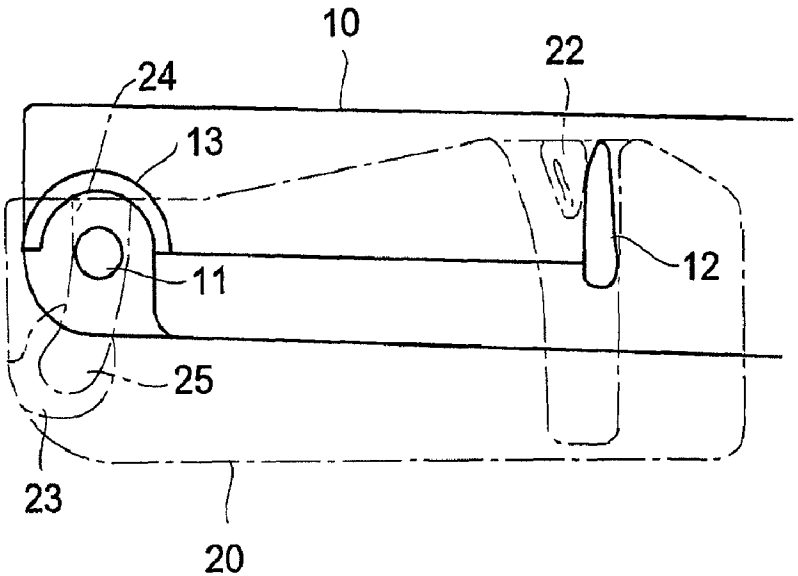

When the handle 5 is further pulled, the cam lever 31 is released from the lock outer cam 12 on the left side. FIG. 21 shows the state at this time. In the same manner as described above, in the cam mechanism on the left side, the hinge pin 11 is relatively guided by the first grooved cam 24 so that the lock outer cam 12 and the slide outer cam 22 are allowed to slide on each other. In the cam mechanism on the right side, the hinge pin 11 is placed at the end portion of the second grooved cam 25 so that the boss 23 starts to slide on the rib 13. With this arrangement, the hinge pin 11 is locked from relative sliding, and supported in a manner so as to freely pivot.

Figure 22:
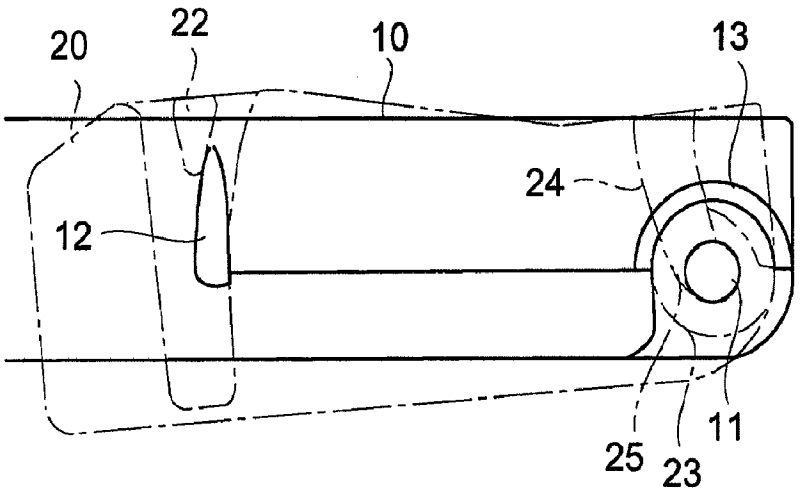
[FIG. 22] A plan view that shows an operation of a cam mechanism upon opening the door of the refrigerator of the first embodiment of the present invention.
Figure 22:
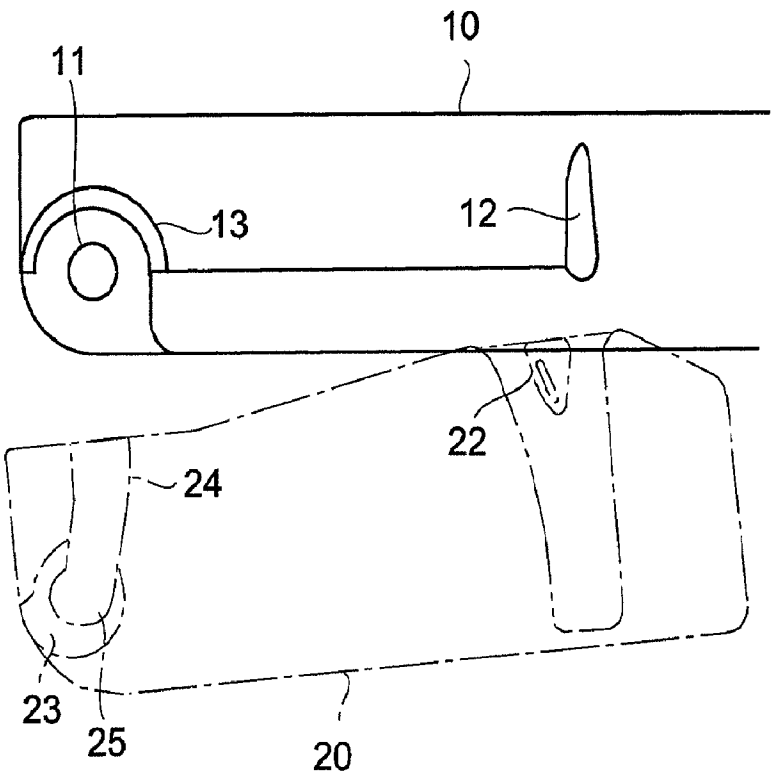

When the handle 5 is further pulled, the engagement of the cam mechanism on the left side is released, as shown in FIG. 22. In the cam mechanism on the right side, the boss 23 is allowed to slide on the rib 13 at the second engaged position so that the slide outer cam 22 guides the lock outer cam 12 to slide therein. Thus, the door 2*a* is opened with the cam mechanism on the right side maintaining at the second engaged position.

In the above-mentioned door 2*a* openable at both the left and right sides thereof, upon opening the door, a sliding shift takes place outward on the opening side. Since the operation portion 5*a* is placed on the center side of the door 2*a* with respect to the shaft 51 that serves as the rotation axis of the handle 5, the operation force of the operation portion 5*a* is exerted outward on the opening side. Therefore, the door 2*a* is easily allowed to slide so that it becomes possible to obtain a door opening and closing mechanism with good operability.

In accordance with the present embodiment, a crank shaft 32, which has the first shaft portion 32*a* that is fitted to the handle 5 so as to freely move therein on the same side as the operation portion 5*a* with respect to the shaft 51 that serves as the rotation axis of the handle 5, and the second shaft portion 32*b* that is formed in parallel with the first shaft portion 32*a* and supported by the door 2*a*, is prepared so that the door opening and closing mechanism can be miniaturized by arranging the handle 5 and the crank shaft 32 so as to be overlapped with each other, and the operation force used for drawing the operation portion 5*a* is amplified by the crank shaft 32 so that the door can be opened with a lighter operation force.

Moreover, the hole 58*a* with which the first shaft portion 32*a* is made in contact forms a first stopper that limits the pivotal movement of the handle 5. In this arrangement, since the first shaft portion 32*a* is made of metal and consequently needs not be reinforced, it becomes possible to limit the pivotal movement of the handle 5 at low costs. Moreover, since the operation portion 5*a* and the first shaft portion 32*a* are placed on the same side with respect to the shaft 51, the operation portion 5*a* and the first shaft portion 32*a* are closely located. For this reason, upon making the first shaft portion 32*a* in contact with the end face of the hole 58*a*, the force to be applied to the hole 58*a* is made smaller, and the torque to be applied to the handle 5 is also made smaller, since the torque is exerted through the first shaft portion 32*a* serving as a fulcrum. Therefore, it becomes possible to prevent the hole 58*a* and the handle 5 from damages.

Moreover, the engaging stopper 58*b* with which the rib 52*c* formed on the end portion of the handle 5 on the side opposite to the operation portion 5*a* with respect the shaft 51 is allowed to form a second stopper that limits the pivotal movement of the handle. With this arrangement, since the hole 58*a* (first stopper) and the engaging stopper 58*b* (second stopper) are allowed to limit the pivotal movement of the handle 5. Thus, loads to be imposed on the hole 58*a* and the engaging stopper 58*b* are dispersed so that it becomes possible to prevent the hole 58*a*, the engaging stopper 58*b* and the handle 5 from damages.

Moreover, since the hole 58*a* is formed in a wall face of the recessed portion 2*b* in which the handle 5 is accommodated, the handle 5 and the hole 58*a* are located closely to each other in the axis direction of the crank shaft 32. In the case when the first stopper to limit the pivotal movement of the handle 5 is apart from the crank shaft 32 in the axis direction thereof, even when the pivotal movement is limited by the first stopper, a great load is imposed on the handle 5 due to the tilted crank shaft 32. Therefore, this arrangement makes it possible to reduce the load due to the tilted crank shaft 32.

Figure 23:
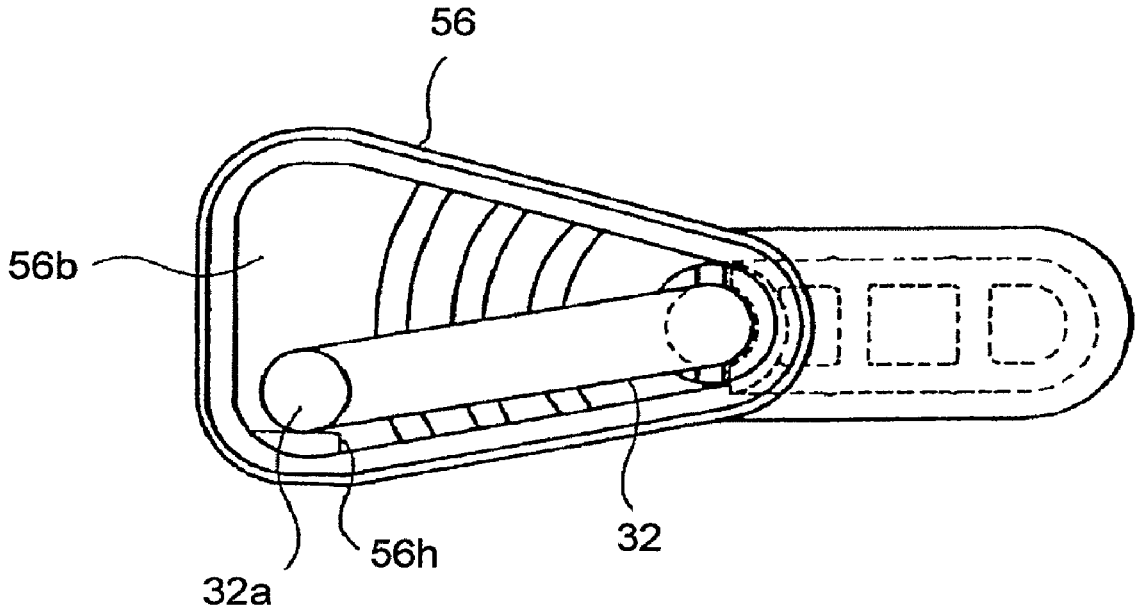
[FIG. 23] A plan view that shows a shaft cover of another mode of the refrigerator of the first embodiment of the present invention.

Moreover, the hole 58*a* is formed with a sufficiently large size so as not to interfere with the pivotal movement of the first shaft portion 32*a* so that the first shaft portion 32*a* is made in contact with the wall face on the inner face side of the first space 56*b* of the shaft cover 56; thus, the pivotal movement of the door 2*a* may be limited. With this arrangement, the wall face on the inner face side of the first space 56*b* is allowed to form the first stopper. Moreover, as shown in FIG. 23, when a protruding portion 56*h*, made of a rib that is made in contact with the first shaft portion 32*a*, is formed in the inner wall of the first space 56*b*, this protruding portion 56*h* serves as the first stopper. Thus, it becomes possible to increase the thickness of the first stopper and consequently to increase the strength thereof.

Figure 24A:
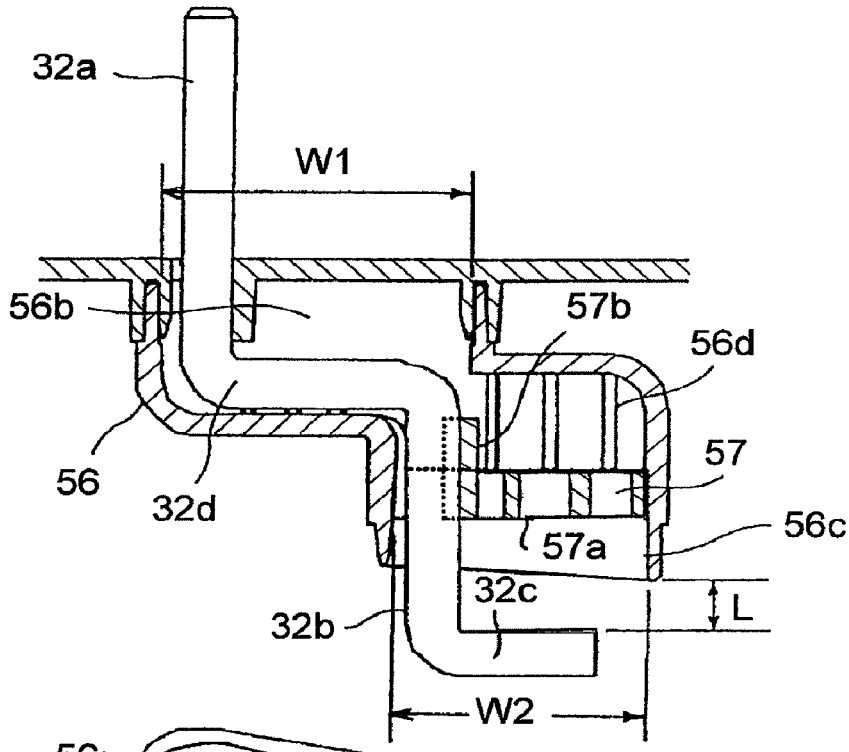
[FIG. 24A] A sectional front view, taken on section A24-A24 in FIG. 24B, that shows a state in which a crank shaft is inserted into a shaft cover in a refrigerator in accordance with a second embodiment of the present invention.
Figure 24B:
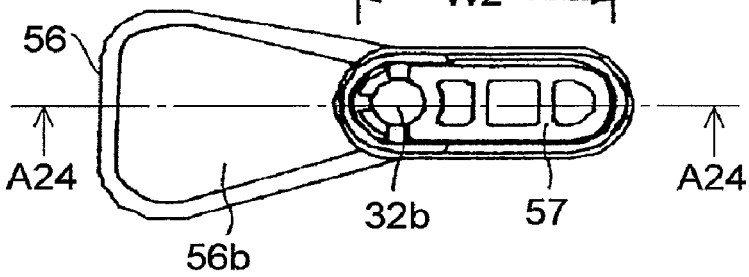
[FIG. 24B] A top view that shows the state in which the crank shaft is inserted into the shaft cover in the refrigerator in accordance with the second embodiment of the present invention.
Figure 25A:
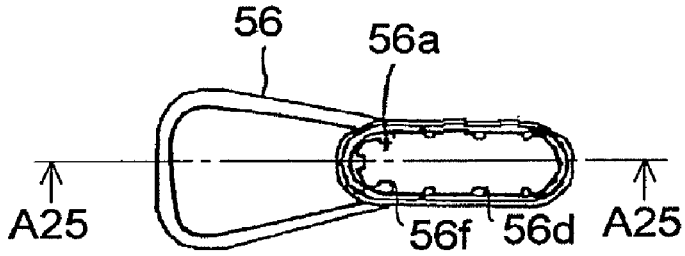
[FIG. 25A] A top view that shows the shaft cover of the refrigerator of the second embodiment of the present invention.
Figure 25B:
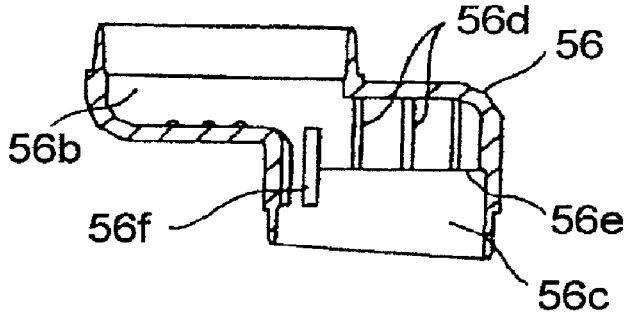
[FIG. 25B] A sectional front view, taken on section A25-A25 in FIG. 25A, that shows the shaft cover of the refrigerator of the second embodiment of the present invention.

Next, FIGS. 24A and 24B are a front sectional view and an upper face sectional view that indicate a state in which a crank shaft 32 is inserted into a shaft cover 56 in the second embodiment, in detail. Moreover, FIGS. 25A and 25A are a plan view and a front sectional view that indicate the shaft cover 56. For convenience of explanation, those members that are the same as those of the first embodiment shown in the aforementioned FIGS. 1 to 23 are indicated by the same reference numerals. The present embodiment is different from the first embodiment in the structure of the shaft cover 56. The other portions are the same as those of the first embodiment.

The shaft cover 56 is formed into a crank shape along the crank shaft 32, and a first space 56*b*, placed on an upper side, through which a first shaft portion 32*a* is inserted and a second space 56*c*, placed on a lower side, through which a second shaft portion 32*b* is inserted are allowed to communicate with each other. The first space 56*b* is formed into a virtually arc shape in its plan view so that the first shaft portion 32*b* and a continuous portion 32*d* are allowed to pivot therein.

The width W1 of the first space 56*b* is made wider than the length of the continuous portion 32*d* of the crank shaft 32. With this arrangement, in the present embodiment, a bent portion 32*c*, which is shorter than the continuous portion 32*d*, is inserted therein from an upper-face open end of the first space 56*b*. Moreover, the bent portion 32*c* is allowed to slide on the bottom face of the first space 56*b* to be placed in the second space 56*c* so that the continuous portion 32*d* is inserted into the first space 56*b*. For this reason, the width W2 of the second space 56*c* is made wider than the length of the bent portion 32*c*, and may be made narrower than the length of the continuous portion 32*d*.

Here, in the case when the continuous portion 32*d* is shorter than the bent portion 32*c*, the continuous portion 32*d* may be inserted from the lower-face open end of the second space 56*c*, and allowed to slide on the upper face of the second space 56*c* to be placed in the first space 56*b*. In this case, since the bent portion 32*c* does not penetrate the inside of the shaft cover 56, it is only necessary to make each of the widths W1 and W2 of the first and second spaces 56*b* and 56*c* wider than the length of the continuous portion 32*d* so that the widths may be narrower than the length of the bent portion 32*c*.

The end portion of the second space 56*c* on the first shaft portion 32*a* is formed into a cylinder face having a semicircular shape in its section, and a fitting section 56*a* is formed on the cylinder face, with a plurality of supporting ribs 56*f* radially protruding therefrom. The second shaft portion 32*b* is fitted to the fitting section 56*a* so that virtually the half circumference thereof is supported with one end the second space 56*c* in the width direction being opened.

The opened side of the second shaft portion 32*b* is made in contact with the supporting member 57 placed inside the second space 56*c*, and supported thereon. Thus, the crank shaft 32 and the cam lever 31 are allowed to constitute the lever member 30 (see FIG. 6) which pivots centered on the second shaft portion 32*b* through the pivotal movement of the handle 5. Moreover, the positional variations of the second shaft portion 32*b* are prevented by the fitting section 56*a* and the supporting member 57 so that the handle 5 is allowed to pivot smoothly. The second shaft portion 32*b* may be slide-rotated with the second shaft portion 32*b* and the supporting member 57 being made in close-contact with each other, or it may be slide-rotated with a slight gap being maintained between the second shaft portion 32*b* and the supporting member 57.

Figure 26A:
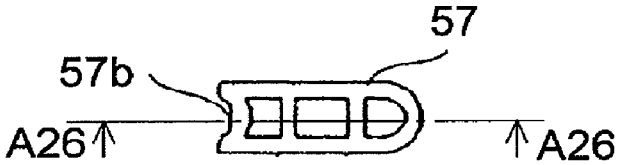
[FIG. 26A] A top view that shows a supporting member of the refrigerator of the second embodiment of the present invention.
Figure 26B:
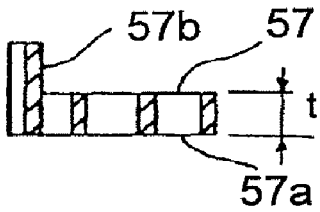
[FIG. 26B] A sectional to view taken on section A26-A26 in FIG. 26A that shows the supporting member of the refrigerator of the second embodiment of the present invention.

FIGS. 26A and 26A are a plan view and a sectional side view that show the supporting member 57. The supporting member 57, which is made of a resin molded product, is constituted by a holding portion 57*a* that is fitted to the second space 56*c* to be held therein and a shaft supporting portion 57*b* that supports the second shaft portion 32*b*. The end face of the shaft supporting portion 57*b* is formed into a cylinder face that is located along the second shaft portion 32*b* and made into a shape elongated longer in the axis direction of the second shaft portion 32*b* than the holding portion 57*a*. Thus, the second shaft portion 32*b* can be supported more positively.

Here, a plurality of ribs 56*d*, which extend in the axis direction of the second shaft portion 32*b*, are provided on the inner wall of the second space portion 56*c* side by side in a direction perpendicular to the axis, in a manner so as to protrude therefrom. Moreover, a step difference 56*e* that connects the lower ends of the ribs 56*d* to one another is formed on the inner wall of the second space portion 56*c*. The supporting member 57, which is inserted from the lower-face open end of the second space portion 56*c*, is made in contact with the ribs 56*d* and the step difference 56*e* to be positioned in the axis direction.

By forming the ribs 56*d* and the step difference 56*e* on the inner circumference of the second space 56*c*, it is possible to prevent the supporting member 57 from tilting. With this arrangement, it becomes possible to prevent the clearance between the second shaft portion 32*b* and the shaft supporting portion 57*b* from becoming partially larger, and consequently to support the second shaft portion 32*b* in a stable manner. The clearance between the second shaft portion 32*b* and the shaft supporting portion 57*b* is preferably set to 2 mm or less. Here, one of the ribs 56*d* and the step difference 56*e* may be omitted; however, by providing the two members, it becomes possible to carry out the supporting process more stably.

Moreover, a distance L between the lower-face open end of the second space 56*c* and the bent portion 32*c* is made longer than the thickness t of the holding portion 57*a*. Thus, the supporting member 57 is easily inserted from the lower-face open end of the second space 56*c*.

In the first and second embodiments, the bottom wall of the refrigerating chamber 2 is pressed by the lever member 30; however, the side wall of the refrigerating chamber 2 may be pressed thereby. Moreover, the door opening and closing mechanism, provided with the handle 5 and the lever member 30, is provided in each of the door 2*a* openable at both the left and right sides thereof; however, the present invention may be applied to a door opening and closing mechanism used for a door openable at both the top and bottom sides thereof in which the handle 5 is vertically placed so that the door 2*a* is rotated by 90 degrees within a plane (for example, a dashboard for a car, an opening and closing door for a dishwasher, etc.) Furthermore, the present invention may be applied to a door opening and closing mechanism used for a freezer or the like in which the opening through which stored goods are put or taken out is placed on the upper face. In addition, among those door opening and closing mechanisms, a one-side door opening and closing mechanism in which any one portion of upper and lower portions, right and left portions, and front and rear portions of the door is pulled to allow the door to pivot may be used.

Furthermore, the same door opening and closing mechanism as the present invention may be provided in a door that is allowed to slide and move forward and backward (for example, a sliding door for a refrigerator). In this case, a shaft 51, which serves as a rotation axis of a handle 5, is laterally placed in the center portion in the lateral direction of a door 2*a*, and an operation portion 5*a* of the handle 5 with a predetermined width in the lateral direction is provided below the shaft 51. Moreover, a recessed portion is formed on the surface of the door 2*a* that faces the lower portion of the handle 5.

The crank shaft 32 is formed in a such manner that the second shaft portion 32*b* extends to the side face of the door 2*a* in the lateral direction, and the cam lever 31 is placed face to face with the body 6 of the side portion of the door 2*a*. With this arrangement, when the fingers are inserted to the rear face of the operation portion 5*a* and the handle 5 is pulled, the cam lever 31 is allowed to press the body 6 on the side of the door 2*a* so that the door 2*a* is separated from the body 6 with a predetermined distance. Here, the operation portion 5*a* of the handle 5 may be placed above the shaft 51.

INDUSTRIAL APPLICABILITY

The present invention can be applied to a door opening and closing mechanism used for opening and closing a door of a refrigerator, a dashboard of a car, a dish washer or the like.

The invention claimed is:

1. A door opening and closing mechanism in which a door to be attached to a body having an opening is separated from, and made in contact with a periphery of the opening so that the opening is opened and closed, comprising:

a handle that is shaft-supported on the door and allowed to pivot, the handle having an operation portion; and a lever member that is provided with a supporting portion that is attached to the door so as to freely pivot thereon, a connecting portion that is connected to the handle so as to freely pivot thereon on the same side as the operation portion with respect to a rotation axis of the handle, and a contact portion that is placed on a side opposite to the connecting portion with respect to the supporting portion and is arranged face to face with the periphery of the opening, wherein, when the operation portion is pulled, the contact portion is allowed to press the body so that the door is separated from the periphery of the opening with a predetermined distance.

2. The door opening and closing mechanism according to claim 1, wherein: the lever member is provided with a crank shaft that forms the connecting portion and the supporting portion in cooperation with first and second shaft portions that are placed in parallel with each other, and the contact portion is perpendicularly provided in the second shaft portion so that the operation portion and the contact portion are placed within different planes that are perpendicular to the rotation axis of the handle.

3. The door opening and closing mechanism according to claim 1, wherein the first shaft portion is fitted to an elongated hole formed in the handle so as to freely pivot therein.

4. The door opening and closing mechanism according to claim 1, wherein the rotation axis of the handle and the contact portion are placed on the side opposite to the connecting portion.

5. The door opening and closing mechanism according to claim 1, wherein: the door is held in the body so as to freely pivot therein, and the pivotal movement of the door allows the opening to be closed and opened.

6. The door opening and closing mechanism according to claim 5, wherein, the handle and the lever member are symmetrically placed on each of two sides of the door, and two cam mechanisms that allow the door and the body to be engaged with, and separated from each other are symmetrically placed on each of the two sides of the door; in a closed state of the door, the cam mechanisms on the two sides of the door are maintained at first symmetrical engaged positions; and upon opening one of the doors, the door is slide-shifted outward from the one door, while the other cam mechanism is shifted to a second engaging position so that the door is locked in a manner so as to freely pivot, with the operation portion being placed in the center side of the doors from the rotation axis of the handle.

7. The door opening and closing mechanism according to claim 1, wherein the door is held in a manner so as to slide backward and forward with respect to the body so that the opening is opened and closed when the door is allowed to slide backward and forward.

8. A door opening and closing mechanism in which a door to be attached to a body having an opening is separated from, and made in contact with a periphery of the opening so that the opening is opened and closed, and having a force-boosting mechanism, the force-boosting mechanism, comprising:

a handle supported on the door by a shaft and having an operation portion at which the handle is held when rotated;

a connected portion having a rotation center on a same side of the shaft as the operation portion, connected to the handle at a position between the rotation center and the shaft, and receiving, when the handle is rotated, an operation force on the handle after boosting; and a contact portion arranged on an opposite side of the rotation center of the connecting portion from the connecting portion, rotating together with the connecting portion to receive a rotation force thereof, and arranged to face the periphery of the opening, wherein, upon rotating the handle, the contact portion is pressed against the body so that the door is separated from the periphery of the opening with a predetermined distance.

9. A door opening and closing mechanism in which a door to be attached to a body having an opening is separated from, and made in contact with a periphery of the opening so that the opening is opened and closed, comprising:

a handle that is shaft-supported on the door and allowed to pivot, the handle having an operation portion;

a crank shaft made of metal, which has a first shaft portion that is placed on a same side as the operation portion with respect to a rotation axis of the handle, and fitted to the handle so as to freely pivot thereon and a second shaft portion that is formed in parallel with the first shaft portion, and supported on the door;

a contact portion that is placed on the second shaft portion on a side opposite to the first shaft portion in a manner so as to extend perpendicularly from the second shaft portion, and aligned face to face with the periphery of the opening; and a first stopper with which the first shaft portion that pivots centered on the second shaft portion is made in contact to regulate the pivotal movement of the handle, wherein, when the operation portion is pulled, the contact portion is allowed to press the body so that the door is separated from the periphery of the opening with a predetermined distance.

10. The door opening and closing mechanism according to claim 9, wherein a second stopper with which an end portion of the handle placed on a side opposite to the operation portion with respect to the rotation axis of the handle is made in contact to regulate the pivotal movement of the handle is provided on the door.

11. The door opening and closing mechanism according to claim 9, wherein: the door comprises a recessed portion in which the handle is accommodated, and the first stopper is formed as a hole portion that is formed into an arc shape concentric with the second shaft portion on a wall face of the recessed portion, with the first shaft portion being inserted through the hole portion.

12. The door opening and closing mechanism according to claim 11, wherein a buffer member, which buffers an impact exerted upon contact with the first shaft portion, is attached to the first stopper.

13. The door opening and closing mechanism according to claim 12, wherein the buffer member is attached onto an inner side of the door from a surface of the recessed portion.

14. The door opening and closing mechanism according to claim 9, wherein the first stopper is formed as an inner face of a shaft cover, placed on the door, through which the crank shaft is inserted.

15. The door opening and closing mechanism according to claim 14, wherein a protruding portion, which is made in contact with the first shaft portion, is formed on an inner wall of the shaft cover.

16. A door opening and closing mechanism in which a door to be attached to a body having an opening is separated from, and made in contact with a periphery of the opening so that the opening is opened and closed, comprising:

a handle that is shaft-supported on the door and allowed to pivot, the handle having an operation portion;

a crank shaft which has a first shaft portion that is placed on a same side as the operation portion with respect to a rotation axis of the handle, and fitted to the handle so as to freely pivot thereon, a second shaft portion that is formed in parallel with the first shaft portion through a connecting portion formed by bending an end portion of the first shaft portion, and supported on the door, and a bent portion that is formed by bending a tip of the second shaft portion in a perpendicular direction toward a side opposite to the first shaft portion;

a contact portion that is attached to the bent portion to be integrally formed with the second shaft portion, and placed face to face with the periphery of the opening;

a shaft cover that is placed on the door with the crank shaft being inserted therein, and has first and second spaces in which the first and second shaft portions are respectively placed with a width that allows at least one of the connecting portion and the bent portion to be inserted therein, with a fitting section to which the second shaft portion is fitted being formed at an end of the second space by opening the end in a width direction thereof; and a supporting member having a holding portion that is fitted to the second space to be held therein and a shaft supporting portion that supports an opened side of the second shaft portion fitted to the fitting section, wherein, when the operation portion is pulled, the contact portion presses the body so that the door is separated from the periphery of the opening with a predetermined distance.

17. The door opening and closing mechanism according to claim 16, wherein the shaft supporting portion has a cylinder face that is formed along a peripheral face of the second shaft portion.

18. The door opening and closing mechanism according to claim 16, wherein the shaft supporting portion is longer than the holding portion in an axis direction of the second shaft portion.

19. The door opening and closing mechanism according to claim 16, wherein a plurality of ribs with which the supporting member is made in contact so as to be position-determined in an axis direction of the supporting member are placed side by side on an inner wall of the second space in a width direction so as to protrude therefrom.

20. The door opening and closing mechanism according to claim 16, wherein a step difference with which the supporting member is made in contact so as to be position-determined in an axis direction of the supporting member is formed on an inner wall of the second space.

21. The door opening and closing mechanism according to claim 16, wherein a distance between an open end of the second space and the bent portion is set to a value greater than the thickness of the holding portion.

* * * * *